US008799104B1

(12) United States Patent
Iwase

(10) Patent No.: US 8,799,104 B1
(45) Date of Patent: Aug. 5, 2014

(54) AUCTION SYSTEM, AUCTION PROCESSING APPARATUS, AUCTION PROCESSING METHOD, AND INFORMATION PROCESSING SYSTEM AND METHOD OF SAME

(75) Inventor: Sumio Iwase, Tokyo (JP)

(73) Assignee: Sony Corporation, Tokyo (JP)

( * ) Notice: Subject to any disclaimer, the term of this patent is extended or adjusted under 35 U.S.C. 154(b) by 3614 days.

(21) Appl. No.: 09/869,993

(22) PCT Filed: Nov. 10, 2000

(86) PCT No.: PCT/JP00/07943

§ 371 (c)(1),
(2), (4) Date: Oct. 15, 2001

(87) PCT Pub. No.: WO01/35286

PCT Pub. Date: May 17, 2001

(30) Foreign Application Priority Data

Nov. 11, 1999 (JP) ..... 11-321439
Nov. 11, 1999 (JP) ..... 11-321441
Nov. 15, 1999 (JP) ..... 11-324064

(51) Int. Cl.
*G06Q 30/00* (2012.01)

(52) U.S. Cl.
USPC ..... 705/26.3; 705/37; 705/80

(58) Field of Classification Search
USPC ..... 705/26.3, 37, 80
See application file for complete search history.

(56) References Cited

U.S. PATENT DOCUMENTS

| | | | | |
|---|---|---|---|---|
| 7,219,080 | B1 * | 5/2007 | Wagoner et al. | 705/37 |
| 7,330,826 | B1 * | 2/2008 | Porat et al. | 705/26 |
| 2002/0072978 | A1 * | 6/2002 | Odom et al. | 705/26 |

FOREIGN PATENT DOCUMENTS

| | | |
|---|---|---|
| JP | 05-324653 | 12/1993 |
| JP | 6-261337 | 9/1994 |
| JP | 06-261337 | 9/1994 |
| JP | 09-006781 | 1/1997 |
| JP | 9-6781 | 1/1997 |
| JP | 10-269447 | 10/1998 |

OTHER PUBLICATIONS

Yokota, et al., "Can Databases Predict Legal Judgments?," Technical research report of Information Processing Society of Japan (IPSJ), (93-DBS-94-4), vol. 93, No. 65, Jul. 23, 1993, pp. 29-38.

Yokota et al. "Can Databases Predict Legal Judgments?" Institute for New Generation Computer Technology (ICOT), Jul. 21, 1993, pp. 29-38.

* cited by examiner

*Primary Examiner* — Sara C Hamilton
(74) *Attorney, Agent, or Firm* — Finnegan, Henderson, Farabow, Garrett & Dunner, LLP

(57) ABSTRACT

An auction system is disclosed in which a submitting node device is configured to transmit to an auction management device product information describing a product, re-auction information indicating whether or not the product is to be re-auctioned when an initial auction fails to result in a transaction, and sale conditions information including sale conditions for the product. The auction management device is configured to present said product for auction, based on said product information. The auction management device is also configured to receive at least one bid indicating purchase conditions from at least one bidding node device. Additionally, the auction management device is configured to determine whether the purchase conditions match the sale conditions. The auction management device is also configured to, when (i) the purchase conditions do not match the sale conditions and (ii) the re-auction information indicates that the product is to be re-auctioned, re-present said product for auction.

5 Claims, 21 Drawing Sheets

2

3

4

AUCTION SYSTEM, AUCTION PROCESSING APPARATUS, AUCTION PROCESSING METHOD, AND INFORMATION PROCESSING SYSTEM AND METHOD OF SAME

TECHNICAL FIELD

The present invention relates to e-commerce such as an auction system conducted via a communication network, more particularly relates to a system, a method, and an apparatus for performing such e-commerce more actively and effectively. More concretely, the present invention relates to an auction system and method making it easier to establish transactions by an auction or capable of easily processing various procedures from a determination of the successful bid to completion of the transaction and an auction processing apparatus and method used in the auction system and an information processing system and method for facilitating resolution of any trouble occurring in such e-commerce.

BACKGROUND ART

The advances made in network techniques or information processing technology have led to the rapid spread of global-scale networks such as the Internet. Various modes of usage of such networks and various services using the networks have been proposed and realized along with this.

One of the services offered via this type of network is auctions conducted over the network—what is called "Internet auctions"—(hereinafter referred to as "network auctions").

An explanation will first be made of the most general method of the network auctions, that is, the reserve designation type method of network auctions.

First, a person who is going to submit a certain article for auction (seller) enters information concerning the article to be submitted into a server of an auction sponsor via the network from his or her terminal. The information to be entered at this time includes an image of the article, a description of the article, the category of the article, minimum reserve, a terms of the auction, etc.

When this information is entered into the server of the auction sponsor, the auction is commenced.

All participants interested in the auction can access the server of the auction sponsor from their terminals connected to the network to view the goods. At this time, usually they can selectively view articles in which they are interested using for example the category as a hint.

When there is an article which a participant wishes to purchase when viewing the products, he or she sends a notification of intent to purchase, that is a bid, indicating his or her desired purchase price.

Then, at the end of the preset auction period, the person who had placed the highest bid wins the auction. Note that if this highest bid does not reach the minimum reserve set by the seller, the transaction fails to be established.

In this way, in a network auction, anyone can easily set up transactions of desired articles or participate in transactions, so this service can be said to sufficiently take advantage of the characteristics of a network.

E-commerce such as such network auctions are expected to spread more widely and develop.

In e-commerce such as such network auctions, however, there are several problems. Transactions cannot be said to be being conducted sufficiently actively.

For example, as mentioned above, in the minimum reserve designation system, a main method of auctions, the transaction fails to be established unless the highest bid of the bidders reaches the minimum reserve designated by the seller. The cause of such a failure of establishment of transactions can be primarily said to be that the minimum reserve set by the seller is too high with respect to the market price. In other words, it can be said that, when general people participate in a network auction, the proper setting of the minimum reserve is difficult. As a result, the percentage of transactions failing to be established becomes high.

Also, if a transaction fails to be established, in actuality most sellers lower the minimum reserve and submit the articles for auction again. In the network auctions up to now, however, even in such a case, they must perform registration procedures of the auction again from the start, so there is a problem of troublesome procedures.

Due to such a problem, the percentage of transactions failing to be established becomes high. This became an obstacle to greater activity in network auctions and transactions based on the same.

Also, in the network auction systems up to now, after the successful bid is determined, both of the seller and the successful bidder usually have to perform the following troublesome procedures.

First, the seller and the successful bidder communicate with each other so that the successful bidder informs his or her address to the seller.

The seller inquires about the shipping fee, insurance fee, etc. to a shipper based on the information and notifies the result to the successful bidder.

Then, when receiving the shipping fee and the insurance fee from the successful bidder together with the product price, the seller requests the shipping from the shipper, packs the product, and actually sends the product.

Namely, in the network auction systems up to now, the sponsor administering the server only notifies the result to the seller and the successful bidder after performing the successful bid processing. As a result, both of the seller and the successful bidder had to perform troublesome and complicated procedures.

Also, not only were the procedures troublesome, but it was also necessary to make inquiries with the shippers and communicate with distant locations. Therefore, there where the problems that a long time was taken until the transaction was completed and the efficiency as the commercial transaction was poor.

This has become an obstacle to greater activity of network auctions and transactions based on the same. Improvement has therefore been demanded.

Further, in recent years, there has been increasing trouble in e-commerce such as such network auctions. This has resulted in a loss of trust in e-commerce and has become an obstacle to broader utilization of e-commerce.

Up to now, when such trouble occurred and the trouble could not be resolved by discussions among the concerned parties, the general practice has been to bring a suit before a court so as to solve the problem by judicial judgement. With such a method, however, there was a problem in that a long time of up to several years and considerable trouble and cost were required until a judgement was rendered and the trouble was resolved.

Therefore, in order to sufficiently deal with the problem of low compensation for damages in e-commerce and improve the feeling of safety with respect to such e-commerce and the stability of e-commerce, it has been demanded to construct a trial system capable of quickly and inexpensively resolve trouble in e-commerce.

DISCLOSURE OF THE INVENTION

An object of the present invention is to provide such an auction system and auction processing method in network auctions enabling easy re-auction in the case of failure of establishment of the transaction and as a result increasing the percentage of articles for which transactions are established even if the pricing is not proper.

Another object of the present invention is to provide an auction processing apparatus and an auction processing method for hosting a network auction enabling easy re-auction in the case of failure of establishment of the transaction.

Still another object of the present invention is to provide an auction processing apparatus and an auction processing method for participating in a network auction enabling easy re-auction in the case of failure of establishment of the transaction.

Still another object of the present invention is to provide an auction system and auction processing method enabling various procedures from the determination of the successful bid to the completion of the transaction to be performed automatically and thereby reducing the complicated trouble and work of participants in the auction, shortening the period from determination of the successful bid to the completion of the transaction, and thereby enabling transactions based on auctions to be efficiently carried out.

Still another object of the present invention is to provide an auction processing apparatus serving as a server and method of the same providing an auction system enabling transactions based on auctions to be efficiently carried out in this way.

Still another object of the present invention is to provide an information processing system and method relating to a trial system enabling quick and inexpensive resolution of trouble in e-commerce.

Accordingly, an auction system of the present invention is a system for hosting an auction in a network to which a plurality of nodes are connected, having a submitting node for transmitting information describing a product and information including sale conditions to a sponsor node for any product and submitting the product in the auction, a sponsor node for disclosing the submitted product as a product for auction by a format enabling viewing from individual nodes, receiving a bid from any node, determining a successful bid from bids having purchase conditions matching with the sale conditions of the product, changing part or all of the content of the disclosure and the sale conditions for a product failing in establishment of a transaction, and including this as a product for auction again, and a bidding node for viewing the product for auction disclosed from the sponsor node via a network and placing a bid with respect to the product desired to be purchased.

In an auction system having such a configuration, a submitter of a product transmits information relating to the submitted product from any node to the sponsor node and applies for submission to the auction (the node at this time becomes the submitting node). Due to this, the sponsor node carries for example an auction list and enables viewing from any node on the network. Then, a person viewing a product and desiring to purchase it places a bid indicating for example a desired purchase price from any node to the sponsor node (the node at this time becomes the bidding node). Then, when the auction period ends, the sponsor node compares the bid conditions and awards the product to for example the bidding node, that is, the bidder, indicating the highest bid. At this time, when no bid reaches the minimum reserve set by the submitter, certain auction submission states or conditions are changed according to a predetermined rule, for example, the minimum reserve is set lower or the category of the product when carried in the auction list is changed, and the product is submitted for auction again.

Also, the auction processing method of the present invention is a method for hosting an auction in a network to which a plurality of nodes are connected, wherein a submitting node transmits information describing a product, information of sale conditions, and information indicating whether or not the product is to be submitted for auction again if a transaction fails to be established to an auction sponsor node for the product to be submitted, the sponsor node receives the information from the submitting node, the sponsor node discloses the submitted product as a product for auction by a format enabling viewing from nodes, a bidding node views products for auction disclosed from the sponsor node via the network, the bidding node places a bid for the product desired to be purchased, the sponsor node receives bids from any bidding nodes, the sponsor node determines the bid indicating purchase conditions matching with the sale conditions of the product as the successful bid, and the sponsor node changes part or all of the content of the disclosure relating to the product and the sale conditions for a product failing in establishment of a transaction and for which an instruction for submitting the same for auction again was given and includes the same as a product for auction again.

Also, an auction processing apparatus of the present invention is an apparatus connected to a network to which a plurality of nodes are connected, receiving a bid transmitted from any node via the network, and hosting the auction of a desired product, having an auction receiving means for receiving an application for auction for any product including information describing the product and information of sale conditions of the product and including the product as a product for auction, a product disclosing means for disclosing any information for the product for auction including information describing the product by a format enabling viewing from any node, a bid receiving means for receiving an application for purchase for the product for auction transmitted from any node including information of the purchase conditions, a successful bid determining means for determining a purchaser of the product from applications for purchase received within a predetermined period for the product for auction and having purchase conditions of the application matching with the sale conditions of the product, and a re-auction means for changing part or all of the sale conditions and the information describing the product to be disclosed according to a predetermined process for a product for which a purchaser could not be determined and including the product as a product for auction again.

Also, another auction processing method of the present invention is a method for receiving a bid transmitted from any node via a network and hosting an auction of a desired product in an apparatus connected to a network to which a plurality of nodes are connected, comprising the steps of receiving an application for auction for any product including information describing the product and information of sale conditions of the product and including the product as a product for auction, disclosing any information including information describing the product by a format enabling viewing of the product for auction from any node, receiving an application of purchase including information of the purchase conditions for the product for auction transmitted from any node, determining a purchaser of the product from applications for purchase received within a predetermined period for the product for auction and having purchase conditions of the applications matching with the sale conditions of the product, and changing part or all of the sale conditions and the information describing the product to be disclosed according to a predetermined process for a product for which the purchaser could not be determined and including the product as a product for auction again.

Also, another auction processing apparatus of the present invention is an apparatus for submitting a product for auction to a system disclosing information describing products and hosting auctions with respect to the products on a network to which a plurality of nodes are connected, having a re-auction instructing means for automatically changing part or all of information describing the product to be disclosed and sale conditions of the product and instructing whether or not the product is to be submitted for auction again when a transaction was not established in an auction and an auction applying means for transmitting information describing a related product including information describing the product to be disclosed, the sale conditions of the product, and the instruction relating to re-auction for a product for submission to the node receiving auctions.

Also, another auction processing method of the present invention is a method for submitting a product for auction to a system disclosing information describing products and hosting auctions for related products on a network to which a plurality of nodes are connected, comprising the steps of generating an application for auction for any product including information describing a product, sale conditions of the product, and an instruction for automatically changing part or all of the information describing the product to be disclosed and the sale conditions and instructing whether or not the product is to be submitted for auction again when a transaction was not established in the auction and transmitting the generated application for auction to the node receiving auctions on the network.

Also, another auction system of the present invention is a system for hosting auctions in a network to which a plurality of nodes are connected, having a submitting means able to transmit information relating to a product to an auction sponsoring means for any product and submit the product for auction, an auction sponsoring means comprised on any node of the network, disclosing the submitted product by a format enabling viewing from any node on the network, receiving a bid from a bidding means on any node, determining the successful bidder for selling the product to from the bidding means placing bids, and transmitting information relating to shipping of the product to the submitting means and the successful bidder, and a bidding means capable of viewing the product for auction disclosed by the auction sponsoring means via the network and capable of placing a bid for a product desired to be purchased.

In the auction system having such a configuration, the auction is commenced by transmitting information relating to a product to the auction sponsoring means by the submitting means and disclosing the submitted product by the auction sponsoring means by a format enabling viewing from any node on the network. Then, by the bidding means viewing the disclosed product and placing a bid for the product desired to be purchased and by the auction sponsoring means receiving this, the bid is established. At the point of time when the auction period ends, for example, the bidding means indicating the highest bid wins the product as the successful bidder. When the successful bid processing ends, the auction sponsoring means transmits information relating to the shipping of the product, for example a shipping fee of the product, an insurance fee accompanied with the shipping, a shipping method, and a pickup date and time to the submitting means and the successful bidder together with for example a result of the successful bid. Accordingly, the submitter of the product and successful bidder perform preparations for shipping based on this information.

Also, another auction processing method of the present invention is a method for hosting an auction in a network to which a plurality of nodes are connected, comprising the steps of disclosing a submitted product by a format enabling viewing from any node on the network, receiving a bid for a product from any node, determining a successful bidder for selling the product to from received bids, and transmitting information relating to the successful bid and information relating to shipping of the product to a submitter of the product and successful bidder.

Also, another auction processing apparatus of the present invention has a shipping information requesting means connected to a network to which a plurality of nodes are connected, transmitting information of the result of a successful bid of an auction to a shipping arranging means on any node on the network, and requesting information relating to shipping of the successfully bid product from a submitter to a successful bidder.

Also, another auction processing apparatus of the present invention is an apparatus connected to a network to which a plurality of nodes are connected and hosting an auction of any product, having a submission receiving means for receiving a submission of any product transmitted from a submitter, a product disclosing means for disclosing the submitted product by a format enabling viewing from any node on the network, a bid receiving means for receiving a bid from a bidding means on any node, a successful bid processing means for determining a successful bidder for selling the product to from the received bids, a shipping information acquiring means for acquiring information relating to the shipping of a successfully bid product from the submitter to the successful bidder based on the result of the successful bid, and a successful bid result transmitting means for transmitting information of the result of the successful bid and information relating to the shipping to the submitter and successful bidder.

Also, another auction processing method of the present invention is a method for hosting an auction of any product in a system connected to a network to which a plurality of nodes are connected, comprising the steps of receiving the submission of any product transmitted from a submitter, disclosing the submitted product by a format enabling viewing from any node on the network, receiving a bid from a bidding means on any node, determining a successful bidder for selling the product to from the received bids, acquiring information relating to the shipping of the successfully bid product from the submitter to the successful bidder based on the result of the successful bid, and transmitting the information of the result of the successful bid and the information relating to shipping to the submitter and successful bidder.

Also, an information processing system of the present invention has a storage means connected to the network and storing required information relating to a service provided on the network as evidence information, a receiving means connected to the network and receiving petition information of a suit with respect to the service transmitted via the network, and a judging means connected to the network and rendering a judgement with respect to the suit based on the petition information and the evidence information stored by the storage means.

Also, an information processing method of the present invention is comprised by a first step of storing required information relating to a service provided on the network as the evidence information in a storage means connected to the network, a second step of raising a suit with respect to the service by transmitting petition information to a trial processing side, and a third step of rendering a judgement with respect to the suit on the trial processing side based on the petition information and the evidence information stored by the storage means.

BRIEF DESCRIPTION OF THE DRAWINGS

The above objects and features of the present invention will become clearer from the following description giving with reference to the attached drawings, in which.

BEST MODE FOR CARRYING OUT THE INVENTION

First Embodiment

An explanation will first be made of a first embodiment of the present invention by referring to FIG. 1 to FIG. 8.

In the following first to fourth embodiments, the present invention will be explained with reference to a network auction system hosting an auction of a desired product on a communication network operated on a global scale such as the Internet.

First, an explanation will be made of the environment for operating the network auction system of the first embodiment by referring to FIG. 1 and FIG. 2.

Figure 1:
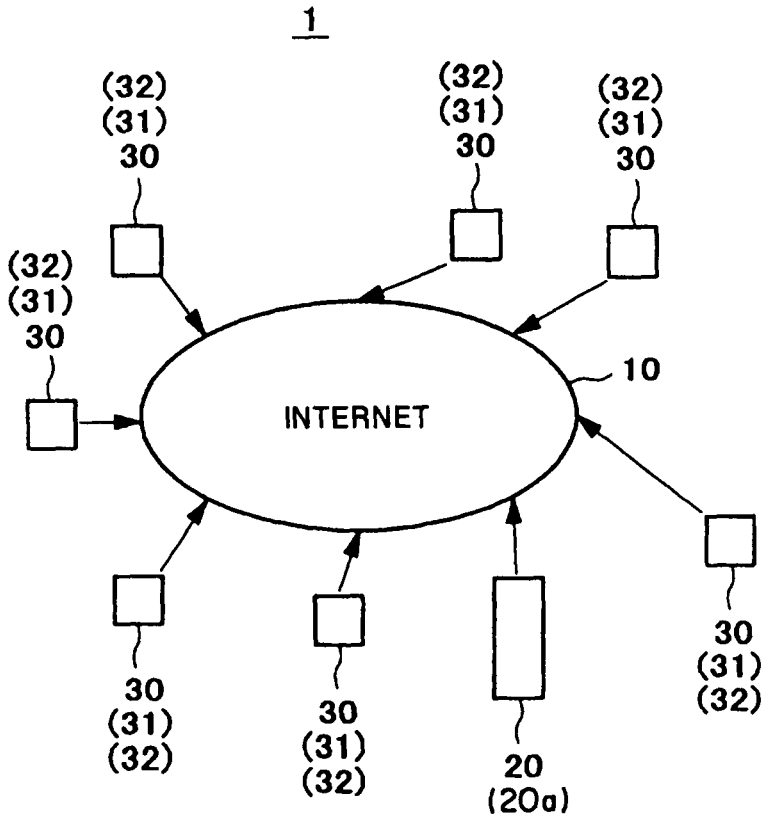
FIG. 1 is a view of an environment for operating a network auction system of a first embodiment of the present invention.

A network auction system 1 of the first embodiment is constructed on a client-server system as shown in FIG. 1 comprised of an auction sponsor server 20 and client devices 30 connected thereto by a network 10.

In order to actively promote auctions, as the network 10, a broader and larger scale network is preferred. In the present embodiment, the network 10 is the Internet.

The auction sponsor server 20 is a device provided with almost all functions for hosting an auction and actually performing the procedures of the auction and is a large scale server having a large capacity recording means, a large number of communication ports capable of parallel communication, and so on.

Each client device 30 is a terminal for submitting products for auction and placing bids and is for example a personal computer or dedicated terminal connected to the network 10.

Here, an explanation will be made of the hardware configurations of the auction sponsor server 20 and the client devices 30.

The hardware configurations of the auction sponsor server 20 and the client devices 30 are functionally similar configurations although there are great differences in capacity and performance. Both are comprised of usual computers.

Figure 2:
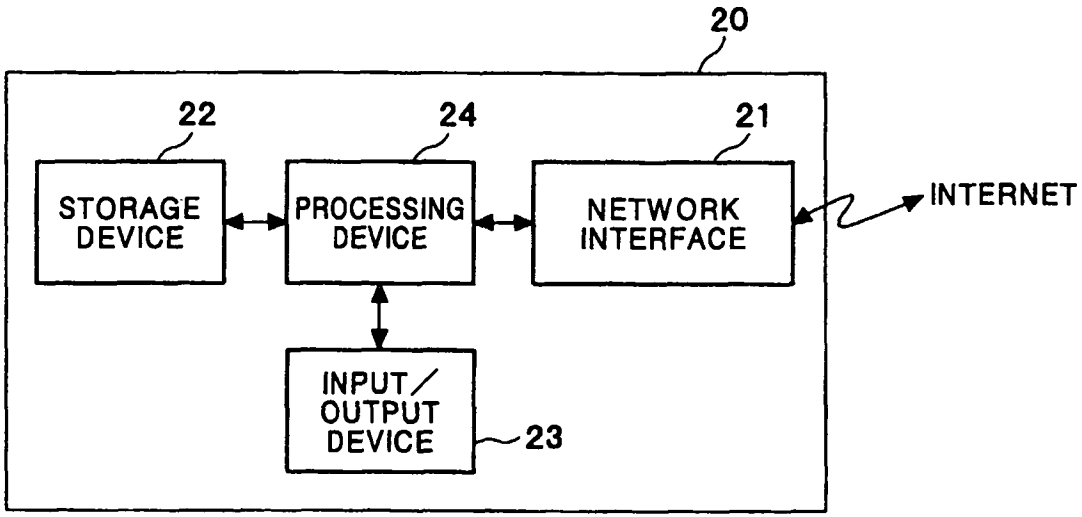
FIG. 2 is a block diagram of the configuration of a server of the network auction system of the first embodiment of the present invention.

The hardware configuration of the auction sponsor server 20 is shown in FIG. 2.

As shown in FIG. 2, the auction sponsor server 20 has a network interface 21, a storage device 22, an input/output device 23, and a processing device 24.

The network interface 21 is an interface for communicating with a large number of client devices 30 for submitting products for auction and placing bids via the network 10 and is capable of simultaneous communication with a large number of destinations.

The storage device 22 is a large capacity storage device for storing programs for realizing the various functions required for the auction sponsor server 20 to operate as the host device of the network auction and various information such as the information of all products for auction, a record of the bids with respect to them, and a record of the bids and/or successful bid up to then.

The input/output device 23 is an input/output terminal for display or print output of various information in the execution of the auction processing to a manager of the auction, the display of various statuses of the auction sponsor server 20 to an operator of the auction sponsor server 20, the operation of the auction sponsor server 20, etc.

The processing device 24 is a processing unit for controlling the network interface 21 and the input/output device 23 according to a program stored in the storage device 22 and performing the desired processing as the host device of the network auction while communicating with the client devices 30 via the network interface 21.

The auction sponsor server 20 operates as the host device of the network auction system 1 by mainly performing various processing by the processing device 24 based on various programs stored in the storage device 22 under such a hardware configuration.

The configuration of each client device 30 is functionally the same as that of the configuration of the auction sponsor server 20 shown in FIG. 2. However, a client device 30 need only function as a terminal of a user participating in the auction, therefore the capacity and performance thereof may be low. In actuality, a client device 30 need only be realized by a computer of the level of a personal computer.

Specifically, in a client device 30, one port for communicating with the auction sponsor server 20 is sufficient as the interface with the network 10.

Also, the information to be stored in the storage device may be only the small amount of information relating to the submission of the product or placement of a bid, so the capacity thereof may be small.

Also, the input/output device preferably has an interface function enabling a person going to participate in an auction to easily submit a product and place a bid.

Further, the processing device only has to function as a terminal of a user participating in an auction, so a processing capability of an extent of a personal computer is sufficient.

A client device 30 submits a product for auction or places a bid for a product for auction at the auction sponsor server 20 under such a hardware configuration.

Next, an explanation will be made of the logical configuration of the network auction system 1 of the first embodiment by referring to FIG. 1 and FIG. 3 to FIG. 8.

As shown in FIG. 1, the network auction system 1 has an auction management device 20*a*, submitting node devices 31; and bidding node devices 32. Namely, the auction management device 20*a* is constructed on the auction sponsor server 20. Also, the submitting node devices 31 and the bidding node devices 32 are constructed on the client devices 30. The submitting node devices 31 and the bidding node devices 32 may be configured so single client devices 30 have both functions simultaneously or may be configured so that single devices have only one function.

First, an explanation will be made of the configurations of the different parts.

Figure 3:
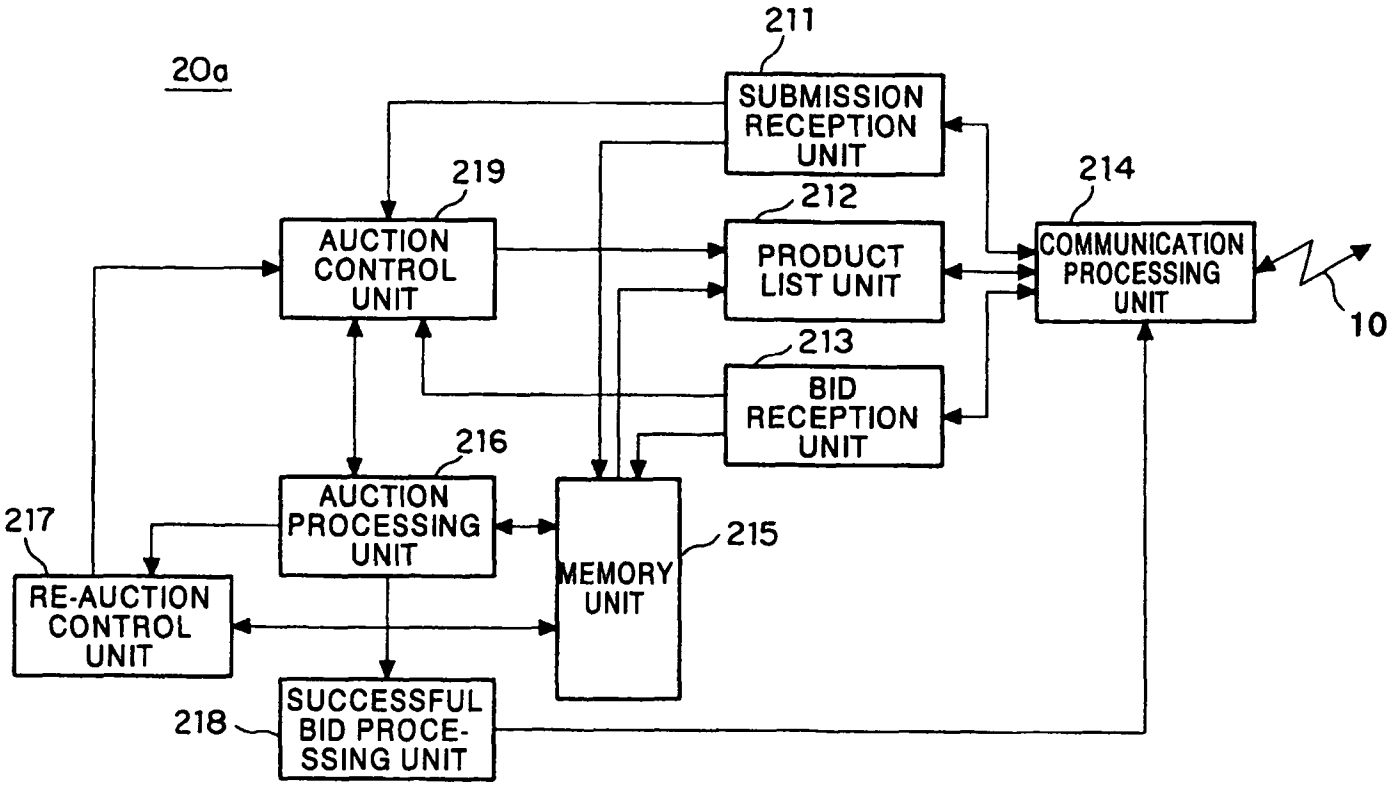
FIG. 3 is a block diagram of the configuration of an auction management device of the network auction system of the first embodiment of the present invention.

An explanation will first be made of the auction management device 20*a* by referring to FIG. 3.

The auction management device 20*a* has a submission reception unit 211, product list unit 212, bid reception unit 213, communication processing unit 214, storage unit 215, auction processing unit 216, re-auction control unit 217, successful bid processing unit 218, and auction control unit 219.

The submission reception unit 211 communicates with a submitting node device 31 via the communication processing unit 214 and the network 10 in accordance with a request from the submitting node device 31 and receives the submission of a product for auction.

When a submitting node device 31 accesses the auction management device 20*a* for the submission of a product for auction, the information is input to the submission reception unit 211 by the communication processing unit 214. The submission reception unit 211 requests the information required for submission, supplies information to be referred to at the time of submission, and so on from and to the submitting node device 31 based on this information and, at the same time, receives information relating to the description of the product required for the submission of the product and the information of the sale conditions. After repeating such sessions with the submitting node device 31 to obtain the information required for the submission of the product, it stores the information in the storage unit 215 and notifies the fact that the product was submitted to the auction control unit 219.

Note that the information relating to the description of the product includes image information of the product, a description of explaining the origin, current state, etc. of the product, and information such as the name and category of the product.

Also, the information of the sale conditions includes information such as an auction period, minimum reserve, possibility of re-auction, maximum number of re-auctions, and the lower limit of the minimum reserve.

The product list unit 212 manages the information of the products for auction, communicates with the bidding node devices 32 via the communication processing unit 214 and the network 10 in response to access from the bidding node devices 32, and provides descriptions of the products for auction and information of the bidding situation such as the highest bid up to then to the bidding node devices 32.

Therefore, when there is a submission of a new product, first the product list unit 212 adds the product to the list of the products for auction so that the information of that product can be provided based on an instruction from the auction control unit 219.

Also, the product list unit 212 checks the highest bid up to then of the product when it is notified of a bid with respect to the product for auction from the auction control unit 219 together with the bid and updates the highest bid if the new bid is more than the highest bid up to then.

Also, the product list unit 212 deletes the product from the list of the products for auction based on an instruction from the auction control unit 219 when the auction period ends.

Then, when a bidding node device 32 accesses the auction management device 20*a* for viewing a product submitted for auction, the information is input to the product list unit 212 by the communication processing unit 214. Therefore, the product list unit 212 appropriately engages in sessions, for example, requests instructions on the category of the product to be viewed etc. from the bidding node device 32 and sequentially provides the information of the products for auction via the communication processing unit 214 according to the requests from the bidding node device 32.

The bid reception unit 213 communicates with a bidding node device 32 via the communication processing unit 214 and the network 10 in response to a request from a bidding node device 32 to receive a bid with respect to an auction.

When a bidding node device 32 accesses the auction management device 20*a* to place a bid for a product for auction, the information is input to the bid reception unit 213 by the communication processing unit 214. The bid reception unit 213 requests the information required for the placement of a bid, supplies information to be referred to at the time of placing a bid, etc. to the bidding node device 32 based on this information, and receives information of the purchase conditions including the bid (desired purchase price) and information of the fact of the placement of a bid from the bidding node device 32. Further, when receiving a bid from a bidding node device 32, this bid information is stored in the storage unit 215 in correspondence to the target product. Also, it notifies the fact that there was a bid to the auction control unit 219 together with the information of the bid.

The communication processing unit 214 controls the communication between the parts of the auction management device 20*a* and the submitting node devices 31 and the bidding node devices 32 via the network 10.

The communication processing unit 214 actually communicates according to a communication protocol or the like and selectively outputs the received information to the concerned parts in accordance with the content of the communication. Namely, the communication processing unit 214 outputs the information to the submission reception unit 211 when the received information relates to access relating to the submission of a product for auction, to the product list unit 212 when it relates to access for viewing products pending in the auction, to the product list unit 213 when it relates to access relating to placement of a bid, and to the successful bid processing unit 218 when it relates to access relating to the processing after determination of the successful bid.

Also, the information for transmission input from the parts is appropriately transmitted to a submitting node device 31 or bidding node device 32 based on the information of the destination of transmission added to the information.

The storage unit 215 stores various information such as the information of the products for auction, a record of the bids with respect to them, and a record of the bidding and/or successful bid ups to then.

The storage unit 215 receives as input the information relating to the submitted product including the information describing the product and the information of the sale conditions from the submission reception unit 211 whenever a product is submitted for auction. Therefore, by newly storing this, the storage unit 215 de facto updates the information of the products for auction.

Also, the information relating to the bidding including the bids is input from the product list unit 213 whenever a bid is placed for a product for auction. The storage unit 215 stores this as the information of the bidding with respect to the product.

Also, when information relating to the successful bid is input from the auction processing unit 216, the storage unit 215 updates the stored information of the products for auction and, at the same time, separately re-stores the product information, bidding information, successful bid information, etc. for the product for which the auction ended not as a product for auction, but as the log information of the auction.

The auction processing unit 216 decides whether or not a transaction is established, that is, whether to award the product to one of the bidders, for a product for auction for which the auction period ends.

The auction processing unit 216 operates under the control of the auction control unit 219, compares the highest bid and the minimum reserve of a product for which the auction period ends from the storage unit 215, and, if the highest bid is the minimum reserve or more, awards the product at that highest price. In this case, the auction processing unit 216 notifies information relating to the successful bid, for example the bidder and bid, to the successful bid processing unit 218.

Alternatively, when the highest bid does not reach the minimum reserve, the transaction fails to be established. In this case, the auction processing unit 216 notifies this to the re-auction control unit 217. Thereafter, the processing for the product shifts to the processing relating to re-auction.

The information relating to the successful bid is also notified to the storage unit 215.

The re-auction control unit 217 performs processing for automatically submitting the product for auction again when receiving notification indicating that a transaction failed to be established from the auction processing unit 216. Concretely, it decides whether or not re-auction is to be carried out and performs the processing for changing the conditions of auction.

The processing of the re-auction control unit 217 will explained in more detail next by referring to the flowchart of FIG. 4. Note that, in the flowchart of FIG. 4 and the following description, for easy understanding, the explanation will be made as a series of auction processings including the processing in the auction processing unit 216 mentioned above.

First, when the auction period ends, in the auction processing unit 216, the processing for determining the successful bidder based on the bidding up to then is commenced (step S10). Namely, as mentioned above, the highest bid and the set minimum reserve of the product are compared (step S11). If the highest bid is the minimum reserve or more, a transaction is established (step S12), and the auction with respect to the product ends (step S13).

On the other hand, when the auction was not established at step S11, the processing shifts to the re-auction control unit 217, the number of re-auctions stored for the product is incremented by one (step S14), and it is checked whether or not the number of re-auctions has exceeded the number of re-auctions set as the maximum number of re-auctions set in advance (step S15).

When the number of re-auctions has exceeded the set number of re-auctions, re-auction is not carried out, a transaction fails to be established (step S18), and the auction with respect to the product ends as it is (step S19).

When the number of re-auctions is within the range of the set number of re-auctions, a certain condition of the auction is changed based on a predetermined method determined in advance (step S16). For example, the description of the product introduced as the product for auction, the category for disclosing the product, the auction period, minimum reserve, etc. is changed to set new auction conditions. Note that, in the present embodiment, the minimum reserve is changed at step S16. The method of change will be explained later with reference to concrete examples.

Next, it is checked whether or not the conditions of re-auction set at step S16 are adequate (step S17). For example, is checked whether or not the changed description of the product and category, auction period, etc. complies with regulations of the auction, it is checked if the changed minimum reserve becomes lower than a similarly set lower limit of the minimum reserve, and other checks are carried out.

When it is judged as a result of the check that the set conditions are not adequate, re-auction is not carried out, a transaction fails to be established (step S18), and the auction with respect to the product ends as it is (step S19).

When it is judged at step S17 that the set conditions are adequate, the re-auction is commenced (step S20). Concretely, the re-auction control unit 217 updates the information stored in the storage unit 215 based on the conditions according to need and notifies the conditions and the fact that re-auction is to be carried out to the auction control unit 219.

Then, the series of processings for determining the successful bidder and processings relating to the re-auction in the auction processing unit 216 and the re-auction control unit 217 are ended (step S20).

Here, an explanation will be made of the processing of step S16 in the processing explained above in the re-auction control unit 217 and the method of changing the minimum reserve with reference to three concrete examples.

Figure 5:
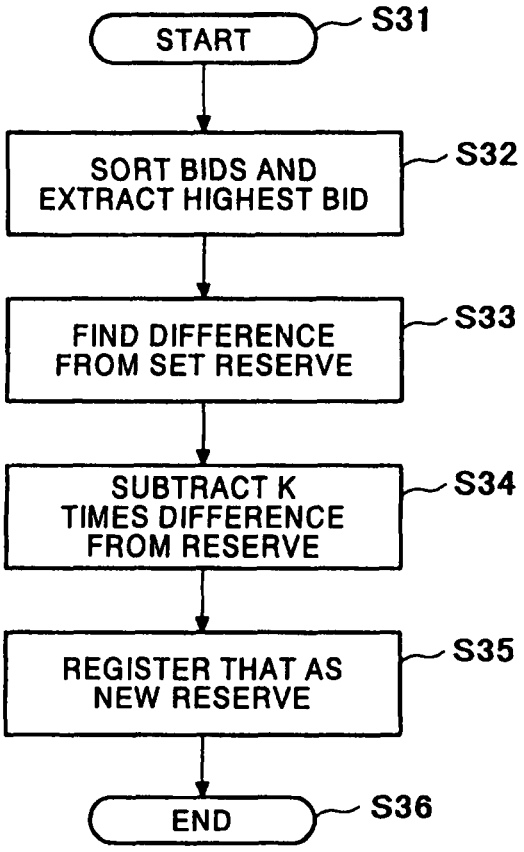
FIG. 5 is a flowchart for explaining a first concrete example of a method for setting a new minimum reserve for the re-auction in the re-auction control unit of the auction management device shown in FIG. 3.

First, as a first example, an explanation will be made of a method of setting a new minimum reserve based on the highest amount of the bids by referring to the flowchart of FIG. 5.

First, when the processing for setting the conditions starts (step S31), the highest bid is extracted by referring to the bids of the bidding at the previous auction stored in the storage unit 215 (step S32).

Next, the difference between the minimum reserve set at the previous auction and the highest bid is found (step S33).

Next, the difference is multiplied by a coefficient k ($0<k<1$) determined in advance, and the result of the multiplication is subtracted from the minimum reserve (step S34).

Then, the price found is registered as a new minimum reserve (step S35), whereby the processing ends (step S36).

According to this method, the minimum reserve will successively approach the highest bid at every re-auction. Accordingly, even if the minimum reserve set by the submitter at first is far away from the market price of the product, the minimum reserve will gradually approach the real price, so the possibility of establishment of a transaction in the auction can be raised.

Next, an explanation will be made of the method of setting a new minimum reserve based on a plurality of bids as a second example with reference to the flowchart of FIG. 6.

First, when the processing for setting the conditions starts (step S40), the highest bid is extracted by referring to the bids of the bidding at the previous auction stored in the storage unit 215 (step S41).

Also, continuously, the second highest bid is extracted (step S42).

Next, the second highest bid is subtracted from the extracted highest bid (step S43), a coefficient $k_1$ ($0<k_1<1$) determined in advance is multiplied with the difference, the result of multiplication is subtracted from the highest bid, and the result is defined as a corrected highest bid (step S44).

Then, the difference between the minimum reserve set at the previous auction and the corrected highest bid is found (step S45), a coefficient $k_2$ ($0<k_2<1$) determined in advance is multiplied with the difference, the result of multiplication is subtracted from the minimum reserve (step S46), and the found price is registered as the new minimum reserve (step S47), whereby the processing ends (step S48).

According to this method, even in a case where the highest bid is very high, a reference price for changing the minimum reserve reflecting the actual distribution of the bids can be set, so a minimum reserve nearer the market price of the product can be set.

Figure 6:
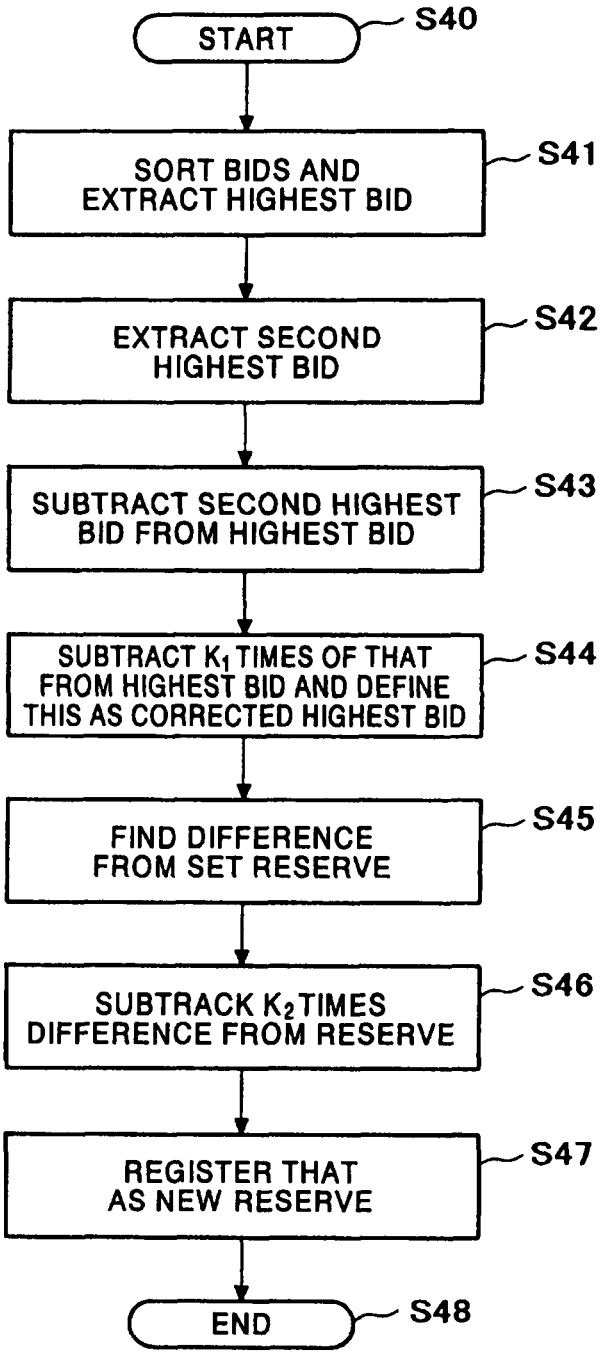
FIG. 6 is a flowchart for explaining a second concrete example of the method for setting a new minimum reserve for the re-auction in the re-auction control unit of the auction management device shown in FIG. 3.

Note that, in the example of FIG. 6, the highest bid corrected by using two highest bids among the bids was found, but the invention is not limited to two. Any number of bids can be used. Also any method of determination of the corrected minimum reserve in that case may be used. For example, the method of using a mean value of a plurality of bids as the corrected highest bid can be used too.

Figure 7:
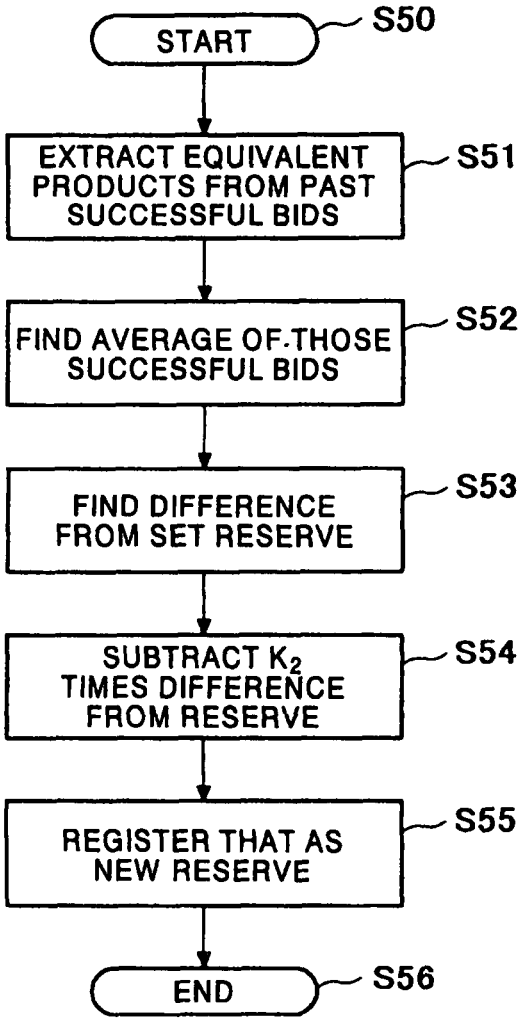
FIG. 7 is a flowchart for explaining a third concrete example of the method for setting a new minimum reserve for the re-auction in the re-auction control unit of the auction management device shown in FIG. 3.

Next, as a third example, an explanation will be made of the method of setting a new minimum reserve based on successful bids of products equivalent to the product for auction with reference to the flowchart of FIG. 7.

First, when the processing for setting the conditions starts (step S50), the results of auctions of products equivalent to the product for re-auction are extracted by referring to the results of auctions in the past stored in the storage unit 215, then the successful bids thereof are extracted (step S51). At this time, the standard for regarding a product as an equivalent product can be set by any information, for example, the category of the product or information given as the description of the product such as the shape, color, or other characteristics of the product, age, manufacturer, and current condition. Also, it is possible to search through all past results to extract equivalent auctioned off articles or search until extracting a predetermined number of auctioned off articles.

After the successful bids of the equivalent products are extracted, a mean price thereof is found (step S52).

Next, the difference between this mean price and the set minimum reserve is found (step S53), a coefficient k ($0<k<1$) determined in advance is multiplied with the difference, and the result of the multiplication is subtracted from the minimum reserve (step S54).

Then, the obtained price is registered as the new minimum reserve (step S55), whereby the processing ends (step S56).

According to this method, the minimum reserve will approach a price inherently close to the price of that product at every re-auction, so it can be said that a suitable auction can be carried out, and the possibility of establishment of a transaction can be raised in the auction as well.

The re-auction control unit 217 has such a configuration.

The successful bid processing unit 218 transmits the information of the auction result and information relating to the actual transaction after that to the submitter and successful bidder of the product when a transaction is established, that is, when a notification that the product was auctioned off to a bidder is sent by the auction processing unit 216.

Also, in certain cases, the successful bid processing unit 218 also transmits the information of the auction result to other bidders who could not make a successful bid.

This information is all transmitted via the communication processing unit 214 to the submitting node device 31 and the bidding node devices 32 engaging in the bidding.

The auction control unit 219 controls the parts of the auction management device 20*a* so that the auction management device 20*a* performs the desired operation as a whole.

Concretely, the auction control unit 219 manages the auction situation and the bidding and successful bid state for all products for auction based on information such as notifications from the submission reception unit 211 indicating that a product was submitted, notifications from the bid reception unit 213 indicating that a bid was placed for a product, notifications of the successful bid result from the auction processing unit 216, and notifications of re-auction from the re-auction control unit 217.

For example, when it is notified from the submission reception unit 211 that a product has been submitted, it instructs the product list unit 212 to list the product as a product for auction and to provide information of the product or, when it is notified that there was a bid placed for the product from the bid reception unit 213 together with the bid, instructs the product list unit 212 to update the information of the highest bid of the product bid on in the information of the products for auction appropriately provided to the outside in response to request according to need.

The above concludes the description of the configuration of the auction management device 20*a*.

Figure 8:
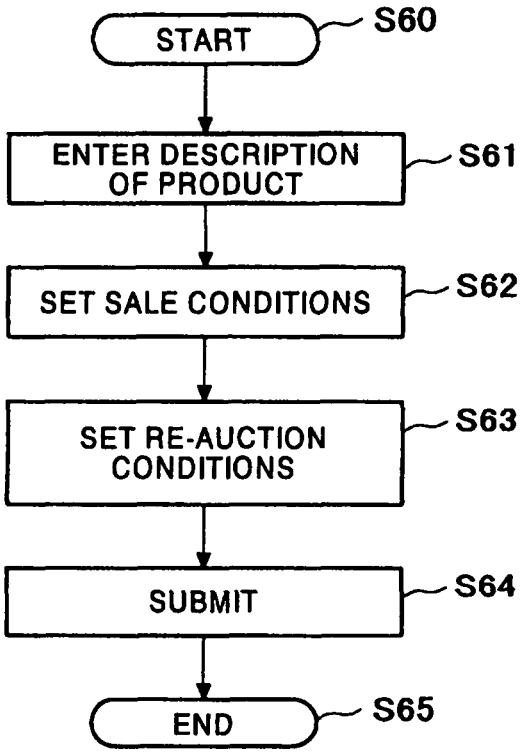
FIG. 8 is a flowchart for explaining processing in a submitting node device of the network auction system of the first embodiment of the present invention.

Next, an explanation will be made of the submitting node device 31 by referring to FIG. 8.

The submitting node device 31 is identical to the client device 30 mentioned above in substance. A client device 30 performing the operation of submitting a product for auction to the auction management device 20*a* is treated as a submitting node device 31 when seen from the auction management device 20*a*.

An explanation will be made of the processing for submitting a product for auction in the submitting node device 31 by referring to FIG. 8.

First, when the processing is commenced (step S60), a description of the product is entered (step S61). Concretely, image data such as a photo of the product is obtained in a transmittable state and a description of for example the name and category of the product and the color, shape, function, purpose, material, manufacturer, year of manufacture, and origin of the product is added.

Next, the sale conditions for the auction are set (step S62). Concretely, conditions such as auction starting time, auction period, and the minimum reserve are set.

Next, the conditions relating to re-auction are set (step S63). Concretely, the possibility and the maximum number of re-auctions, the lower limit of the minimum reserve when the minimum reserve is changed at every re-auction, the portion to change and the content of the change when changing the description of the product to be viewed at every re-auction, the period for change when changing the auction period at every re-auction, the category to be changed to when changing the category of the product at every re-auction, etc. are set according to need.

After such processing, the auction management device 20*a* is sent information on the application of submission for auction including the description and the settings (step S64), whereby the submission processing ends (step S65).

Note that it is possible to independently perform these processings in the submitting node device 31 or to sequentially perform them under the guidance or the like from the auction management device 20*a* while communicating with the auction management device 20*a*.

Next, an explanation will be made of a bidding node device 32.

The bidding node device 32 is identical to the client device 30 mentioned above in substance. A client device 30 performing the operation of viewing products pending in the auction and the operation of bidding to the auction management device 20*a* is treated as a bidding node device 32 when seen from the auction management device 20*a*.

Note that the configuration of the bidding node device 32 may be identical to a terminal for bidding used in the conventional network auction system.

The processing for viewing the products pending in the auction in the bidding node device 32 is realized by accessing the auction management device 20*a* via the network 10 and following the instructions of the interface provided by the auction management device 20*a*. Namely, viewing can be carried out without using a special tool by a method the same as the viewing the usual web.

Also, the processing for bidding in an auction in the bidding node device 32 can also be carried out by just following the instructions of the interface provided by the auction management device 2 to select the product and set the desired purchase price (bid).

Next, the operation of a network auction system 1 having such a configuration will be explained.

First, a submitter desiring to submit a certain product for auction transmits an auction submission application including a description of the product, sale conditions, etc. to the auction management device 20*a* from a submitting node device 31 (client device 30). At this time, information indicating whether or not re-auction is to be carried out if a transaction fails to be established in the auction and, if re-auction is to be carried out, how the description of the product and sale conditions are to be changed for re-auction is set together.

In the auction management device 20*a*, when the submission reception unit 211 receives such an application via the communication processing unit 214, the information is stored in the storage unit 215 and the product is entered in the list as a product for auction by the product list unit 212.

Thereafter, during the auction period set by the submitter, it becomes possible to view the information relating to this product from any client device 30 connected to the network 10.

Then, a potential purchaser interested in this product transmits an application of purchase (places a bid) including the desired purchase price (bid) to the auction management device 20*a* from a bidding node device 32 (client device 30).

In the auction management device 20*a*, the product list unit 213 receives this via the communication processing unit 214 and stores this once in the storage unit 215. Note that when the bid of the bidding is the highest bid of that product up to then, the information is transferred via the auction control unit 219 to the product list unit 212 to update the information of the list provided by the product list unit 212.

Then, when the auction period ends, the auction processing unit 216 reads the bidding information for the product from the storage unit 215, detects the highest bid, and examines if this is the minimum reserve set by the submitter or more.

When the highest bid is the minimum reserve or more, the transaction is established, the successful bid processing unit 218 sends notification indicating this to both of the submitter and successful bidder, and the series of auction processing concerning that product is ended.

On the other hand, when the highest bid is lower than the minimum reserve, the re-auction control unit 217 reads the conditions of the re-auction set by the submitter from the storage unit 215 and checks whether or not re-auction is to be carried out.

Then, when re-auction is carried out, new auction conditions are set again based on the conditions of the re-auction similarly set by the submitter, and the re-auction is commenced under the control from the auction control unit 219.

Thereafter, processings similar to those of the first auction mentioned above are sequentially carried out with respect to this re-auction.

As explained above, in the network auction system 1 of the first embodiment, if set at the time of submission of the product, even if a transaction fails to be established by the auction, the sale conditions etc. are automatically changed and the product is submitted for re-auction. Accordingly, the trouble involved in re-auction can be eliminated, so it becomes possible to easily submit a product for auction.

Also, the conditions of the re-auction at that time can be set by any method, so the product can be submitted for auction in the format desired by the submitter.

Also, in the method of re-auction by changing the minimum reserve, the minimum reserve can be made to gradually approach to the actual price on the market or a price corresponding to the value inherently possessed by that product at every re-auction. Accordingly, even if a price far away from the market price is set at first, it becomes a more adequate price at every re-auction, so the possibility of a successful bid gradually becomes higher and, as a result, the percentage of establishment of transactions can be raised.

Therefore, as a result, it becomes easier to participate in an auction, network auctions are stimulated, and product transactions via network auction can be stimulated.

Second Embodiment

An explanation will next be made of a second embodiment of the present invention by referring to FIG. 9 to FIG. 11.

Figure 9:
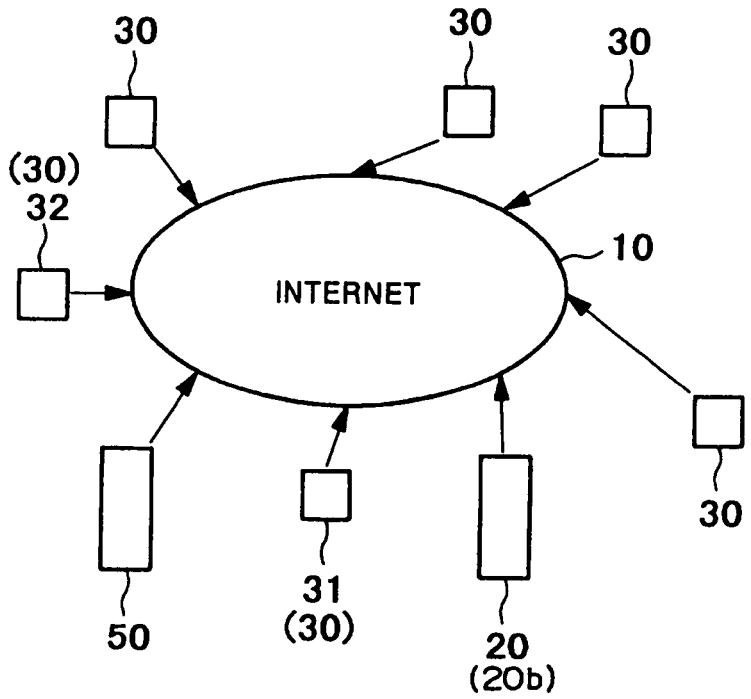
FIG. 9 is a view of an environment for operating a network auction system of a second embodiment of the present invention.

First, the environment for operating the network auction system of the second embodiment will be briefly explained by referring to FIG. 9.

A network auction system 2 of the second embodiment is constructed on a system comprised of a auction sponsor server 20, client devices 30, and a shipper server 50 connected thereto by the network 10 as shown in FIG. 9.

The environment shown in FIG. 9 is the environment where the network auction system 1 of the first embodiment explained by referring to FIG. 1 operated plus the shipper server 50.

The configurations of the network 10, auction sponsor server 20, and the client device 30 are the same as the configurations of the corresponding devices of the network auction system 1 of the first embodiment, so the descriptions thereof will be omitted.

The shipper server 50 is the server of a shipper arranging the shipping of the successfully bid on articles of the auction in response to a request from the auction sponsor server 20. It also performs business applications of the shipper itself and manages the shipped goods, therefore is a medium sized server having a certain high level of performance.

Also, the hardware configuration of the shipper server 50 is functionally similar to those of the auction sponsor server 20 and client device 30 explained by referring to FIG. 2 though there is a great difference in the capacity and performance. All are configurations of usual computers.

The characterizing point is that the shipper server 50 must communicate with branches etc. of the shipper to manage the shipped goods in addition to communicating with the auction sponsor server 20, so the interface with the network 10 is configured to enable high speed communication.

Also the storage device needs a certain degree of capacity since the program and data for managing all goods shipped by the shipper are stored in addition to the program and data for arranging the shipping for products successfully bid on at the auction.

The input/output device, in the same way as the auction sponsor server 20, need only have functions sufficient for maintenance and management of the shipper server 50.

The processing apparatus must arrange for the shipping of the successfully bid on products while performing processing to manage all shipped goods of the shipper, so desirably has a high performance.

The shipper server 50 performs processing relating to the shipping of products successfully bid on at the auction in response to inquiries from the auction sponsor server 20 under such a hardware configuration.

Next, an explanation will be made of the logical configuration of the network auction system 2 of the second embodiment by referring to FIG. 9 and FIG. 10 to FIG. 14.

The network auction system 2 has an auction management device 20*b*, submitting node devices 31, bidding node devices 32, and a shipping arrangement device 50.

FIG. 9 previously referred to is also a view of the configuration of the network auction system 2. As shown in FIG. 9, the auction management device 20*b* is constructed on the auction sponsor server 20.

Also, the submitting node devices 31 and the bidding node devices 32 are constructed on the client devices 30. The submitting node devices 31 and the bidding node devices 32 may be configured so single client devices 30 have both functions simultaneously or may be configured so that single devices have only one function.

Also, the shipping arrangement device 50 is constructed on the shipper server 50.

First, an explanation will be made of the configurations of the parts.

First, an explanation will be made of the auction management device 20*b* by referring to FIG. 10.

The auction management device 20*b* has a submission reception unit 221, product list unit 222, bid reception unit 223, communication processing unit 224, storage unit 225, auction processing unit 226, shipping processing unit 228, and auction control unit 229.

The submission reception unit 221 communicates with the submitting node devices 31 via the communication processing unit 224 and the network 10 in accordance with requests from the submitting node devices 31 and receives the submission of products for auction.

When the submitting node device 31 accesses the auction management device 20*b* for submission of a product for auction, the information is input to the submission reception unit 221 by the communication processing unit 224. The submission reception unit 221 requests the information required for submission, supplies information to be referred to at the time of submission, and so on with respect to the submitting node device 31. Then, finally, it receives information relating to the description of the product required for the submission of the product and the information of the sale conditions, stores these information in the storage unit 215, and notifies the fact that a product was submitted to the auction control unit 229.

Note that the information relating to the description of the product includes image information of the product, a description of explaining the origin, current state, etc. of the product, and information such as the name and category of the product.

Also, the information of the sale conditions includes information such as an auction period and minimum reserve.

The product list unit 222 manages the information of the products for auction, communicates with the bidding node devices 32 via the communication processing unit 224 and the network 10 in response to access from the bidding node devices 32, and provides information of the products for auction to the bidding node devices 32.

Therefore, when there is a submission of a new product, first the product list unit 222 adds the product to the list of the products for auction so that the information of that product can be provided based on an instruction from the auction control unit 229. Also, it deletes the product from the list of the products for auction based on an instruction from the auction control unit 229 when the auction period ends.

Then, when there is an access from a bidding node device 32, it appropriately engages in sessions, for example, requests instructions on the category of the product desired to be viewed etc. from the bidding node device 32 and sequentially provides the information of the products for auction according to the requests from the bidding node device 32.

The bid reception unit 223 communicates with a bidding node device 32 via the communication processing unit 224 and the network 10 in response to a request from a bidding node device 32 to receive a bid with respect to an auction.

When a bidding node device 32 accesses the auction management device 20*b* to place a bid for a product for auction, the bid reception unit 223 requests the information required for the placement of a bid, supplies information to be referred to at the time of placing a bid, etc. to the bidding node device 32, and receives information of the purchase conditions including the bid (desired purchase price) from the bidding node device 32. Further, it stores this bid information in the storage unit 215 in correspondence to the target product. Also, it notifies the fact that there was a bid to the auction control unit 229 together with the information of the bid.

The communication processing unit 224 controls the communication between the parts of the auction management device 20*b* and the submitting node devices 31, the bidding node devices 32, and the shipping arrangement device 50 via the network 10.

The communication processing unit 224 actually communicates according to a communication protocol or the like and selectively outputs the received information to the concerned parts in accordance with the content of the communication.

Namely, the communication processing unit 224 outputs the information to the submission reception unit 221 when the received information relates to access relating to the submission of a product for auction, to the product list unit 222 when it relates to access for viewing a product pending in the auction, to the bid reception unit 223 when it relates to access relating to bidding, and to the shipping processing 228 when it relates to access relating to the shipping processing after the determination of the successful bid and the notification of the result.

Also, the information to be transmitted input from the parts is appropriately transmitted to the submitting node device 31, bidding node device 32, or the shipping arrangement device 50 based on the information of the destination of transmission added to the information.

The storage unit 225 stores the information of the products for auction, the record of bidding with respect to them, the record of bidding and/or successful bids up to then, and so on.

The storage unit 225 receives as input information relating to the submitted product including information describing the product and the information of the sale conditions from the submission reception unit 221 whenever a product is submitted for auction. Therefore, by newly storing this, it de facto updates the information of the products for auction.

Also, the information relating to the bidding including the bid is input from the product list unit 223 whenever a bid is placed for a product for auction, so it stores this as the information of the bidding with respect to the product.

Also, when the successful bid result is input from the auction processing unit 226, it updates the stored information of the products for auction.

The auction processing unit 226 decides whether or not a transaction is established, that is, if the product has been auctioned off to one of the bidders, for a product for auction for which the auction period ends.

The auction processing unit 226 reads the highest bid of the product for which the auction period ends from the storage unit 225 under the control from the auction control unit 229, compares this with the minimum reserve set by the submitter, and, if the highest bid is the minimum reserve or more, auctions off the product at that highest price.

Then, when auctioning off the product, it notifies information relating to the successfully bid product and the submitter and bidder of that product to the shipping processing unit 228.

Note that, when the highest bid does not reach the minimum reserve, the transaction fails to be established, and the processing relating to the auction ends.

Also, the result of the successful bid processing is also notified to the storage unit 225.

The shipping processing unit 228 communicates with the shipping arrangement device 50 to obtain the information relating to the shipping of that product based on the information relating to the successfully bid product and the submitter and the successful bidder of that product input from the auction processing unit 226 for the successfully bid product and transmits the same together with the successful bid result to the submitting node device 31 and the bidding node device 32.

An explanation will next be made of the processing in the shipping processing unit 228 by referring to FIG. 11. Note that, in FIG. 11, for easy understanding, the processing of the shipping processing unit 228 including also the successful bid processing in the auction processing unit 226 is shown.

First, when the auction period ends for a certain product, a series of processings is commenced (step S70), and the successful bid processing as mentioned above is carried out in the auction processing unit 226 (step S71).

Then, when the successful bid is established, the information relating to the product, the submitter, and the successful bidder is input from the auction processing unit 226 to the shipping processing unit 228. The shipping processing unit 228 extracts predetermined information upon request from the shipping arrangement device 50 required for insuring and shipping the product from this information and transmits the same via the communication processing unit 224 to the shipping arrangement device 50 (step S72).

In the second embodiment, information relating to the product input by the submitter and indicating the size, shape, weight, material, structure, handling precautions, and any other information of the product, a photo of the product, the successful bid of that product, address of the submitter, pickup conditions, address of the successful bidder, and the shipping conditions are transmitted to the shipping arrangement device 50.

As a result, information relating to shipping such as the shipping fee and the delivery time and information relating to the insurance such as the insurance fee are transmitted from the shipping arrangement device 50 and received via the communication processing unit 224 (step S73).

In the second embodiment, information such as the shipping fee and insurance fee of the product, scheduled pickup time, scheduled delivery time, pickup method, pickup conditions, shipping method, and shipping conditions are transmitted from the shipping arrangement device 50.

Then, the required information is extracted from the successful bid result input from the auction processing unit 226 and the shipping information input from the shipping arrangement device 50 and transmitted to the submitter and the successful bidder (step S74), whereby the series of processings after determination of the successful bid is ended (step S75).

In the second embodiment, the information of the successfully bid product and the information of the names, addresses, telephone numbers for contact, IP addresses, etc. of both of the submitter and the successful bidder are augmented by the information relating to the shipping of the product received from the shipping arrangement device 50 and then transmitted to the submitter and the successful bidder.

The auction control unit 229 controls the parts of the auction management device 20*b* so that the auction management device 20*b* performs the desired operation as a whole.

Concretely, the auction control unit 229 manages the auction situation, the bidding and/or successful bid state of the products for auction, and so on based on the information such as notifications from the submission reception unit 221 indicating that a product was submitted, notifications from the bid reception unit 223 indicating that a bid was placed with respect to a product, and notifications of successful bid results from the auction processing unit 226.

The above concludes the explanation of the configuration of the auction management device 20*b*.

Next, an explanation will be made of a submitting node device 31.

A submitting node device 31 is identical in substance to the client device 30 mentioned above. A client device 30 performing the operation of submitting a product for auction to the auction management device 20*b* is treated as a submitting node device 31 when seen from the auction management device 20*b*.

The submitting node device 31 performs the processing for submitting a product for auction as follows.

First, a description of the product to be submitted is prepared. Concretely, image data such as a photo of the product is obtained in a transmittable state and a description of for example the name and category of the product and the color, shape, function, purpose, material, manufacturer, year of manufacture, and origin of the product is added.

Next, the auction starting time, auction period, minimum reserve, and other sale conditions for the auction are set.

Next, the description and settings are transmitted to the auction management device 20*b*.

This ends the processing for submitting a product for auction.

Note that these processings may be independently carried out in the submitting node device 31 or may be sequentially carried out under the guidance or the like from the auction management device 20*b* while communicating with the auction management device 20*b*.

Next, an explanation will be made of a bidding node, device 32.

A bidding node device 32 is identical in substance to the client device 30 mentioned above. A client device 30 performing the operation of viewing the products submitted for the auction and the operation of placing a bid at the auction management device 20*b* is treated as a bidding node device 32 when seen from the auction management device 20*b*.

Note that, among the bidding node devices 32, the node making the successful bid is used as the successful bidding node device 32 in the figures and explanation.

The processing for viewing products submitted for the auction in a bidding node device 32 is realized by accessing the auction management device 20*b* via the network 10 and following the instructions of the interface provided by the auction management device 20*b*. Namely, it can be carried out without using a special tool by the same method as that for viewing the usual web.

Also, the processing for placing a bid in the auction in the bidding node device 32 can be carried out by just selecting a product according to the interface provided by the auction management device 20*b* and setting the desired purchase price (bid).

Next, an explanation will be made of the shipping arrangement device 50.

The shipping arrangement device 50 is identical in substance to the shipper server 50 mentioned above. In particular, it performs the shipping arrangements for a product in response to an inquiry from the auction sponsor server 20 and transmits the information relating to the shipping to the auction management device 20*b*.

The shipping arrangement device 50, as mentioned above, is sent the information relating to the product, submitter, and the successful bidder from the auction management device 20*b*. Concretely, information indicating the size, shape, weight, material, structure, handling precautions, and any other information of the product, a photo of the product, the successful bid of that product, address of the submitter, pickup conditions, address of the successful bidder, and the shipping conditions are transmitted.

The shipping arrangement device 50 performs the arrangements for shipping, calculates the fees, etc. based on these information.

For example, the shipping arrangement device 50 calculates a basic fee of the shipping fee based on the addresses of the submitter and the successful bidder and the size and weight of the product.

Then, the pickup method or pickup conditions or the shipping method and shipping conditions are designated according to need based on the information such as the shape, material, and structure of the product and the precautions in handling, and an additional fee or the like is calculated according to need.

Also, the actual pickup work and shipping work are immediately arranged, and the pickup date and the delivery date are determined from the set schedule.

Also, an insurance fee is set based on the successful bid, and insurance conditions such as an escape clause are set based on the other information of the product.

Then, the obtained information is transmitted to the auction management device 20*b*.

Next, the operation of the network auction system 2 having such a configuration will be explained together.

First, the submitter desiring to submit a certain product for auction transmits an auction submission application including a description of the product, sale conditions, etc. to the auction management device 20*b* from a submitting node device 31 (client device 30).

In the auction management device 20*b*, when the submission reception unit 221 receives such an application via the communication processing unit 224, the information is stored in the storage unit 225 and the product is recorded on the list as a product for auction by the product list unit 222.

Thereafter, during the auction period set by the submitter, it becomes possible to view the information relating to this product by any client device 30 connected to the network 10.

Then, a potential purchaser interested in this product transmits an application of purchase (bidding) including the desired purchase price (bid) to the auction management device 20*b* from a bidding node device 32 (client device 30).

In the auction management device 20*b*, the bid reception unit 223 receives this via the communication processing unit 224 and stores this once in the storage unit 225. Note, when the bid of the bidding is the highest bid of that product up to then, the information is transferred via the auction control unit 229 to the product list unit 222 and the information of the list provided by the product list unit 222 is updated.

Then, when the auction period ends, the auction processing unit 226 reads the bidding information with respect to the product from the storage unit 225, detects the highest bid, and, if this is the minimum reserve set by the submitter or more, awards the product to the node device 32 bidding with the highest price.

Then, when the successful bid is determined, the shipping processing unit 228 transmits the information of that product, the information of the submitter of that product, and the information of the successful bidder to the shipping arrangement device 50 via the communication processing unit 224.

By this, in the shipping arrangement device 50, the costs, including the shipping fee and the insurance fee, for shipping that product from the submitter to the successful bidder are calculated and the actual arrangements of shipping made, then the information such as the costs and delivery date is returned to the shipping processing unit 228.

The shipping processing unit 228 adds the information relating to the shipping transmitted from the shipping arrangement device 50 to the information of the successfully bid product, submitter, and successful bidder as the information of the results of the successful bid and notifies the same as the result of the auction to the submitter and the successful bidder.

As explained above, in the network auction system 2 of the second embodiment, when a product is successfully bid on in the auction, the information of the results of the successful bid plus the information such as the shipping fee, insurance fee, and the delivery date is transmitted together with the successful bid results to the submitter and the successful bidder.

Accordingly, procedures which have been conventionally required when the transaction is to be actually carried out after the end of the auction, such as the inquiry of the shipping fee and insurance fee to the shipper, the inquiry of the pickup date and required period of shipping, and the request of the shipping become unnecessary.

Namely, the complicated trouble after determination of a successful bid is remarkably reduced.

Also, processing such as the inquiry of the shipping fee and insurance fee and communication between distant places between the submitter and the successful bidder become unnecessary, so the period from the determination of the successful bid to the end of the actual transaction of the product can be greatly shortened, and an efficient commercial transaction based on an auction can be realized.

Also, the shipping schedule can be quickly set and transmitted, therefore the processing relating to shipping can be methodically and efficiently carried out by the submitter, successful bidder, and the shipper.

As a result, it becomes easy to participate in an auction, network auctions are stimulated, and product transactions via network auctions can be stimulated.

Third Embodiment

An explanation will next be made of a third embodiment of the present invention by referring to FIG. 12 and FIG. 13.

The second embodiment was predicated on the shipper entrusted with the shipping of the successfully bid product being determined by some sort of method.

However, a cheaper shipping cost is more desirable and a shorter shipping term is more preferred. Therefore, desirably the shipper submitting the best conditions is selected. The present invention can be worked by such a system too.

Therefore, as the third embodiment, an explanation will be made of a network auction system wherein, when entrusting the shipping of the successfully bid product, information relating to shipping is obtained from a plurality of shippers and one shipper is selected based on this.

Note that, here, the explanation will be made only of the differences from the network auction system 2 of the second embodiment.

Figure 12:
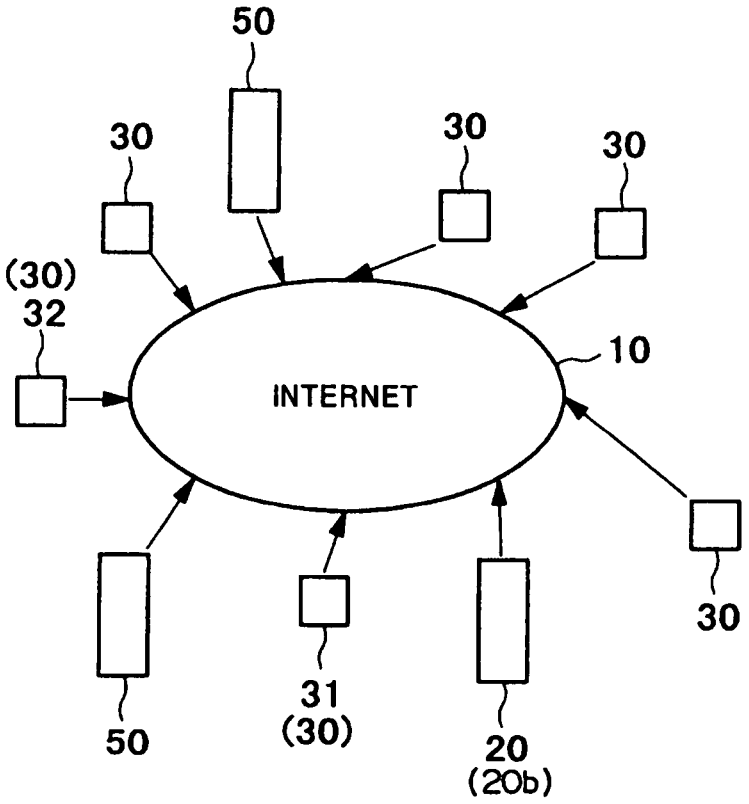
FIG. 12 is a block diagram of the configuration of an auction management device of a network auction system of a third embodiment of the present invention.
Figure 13:
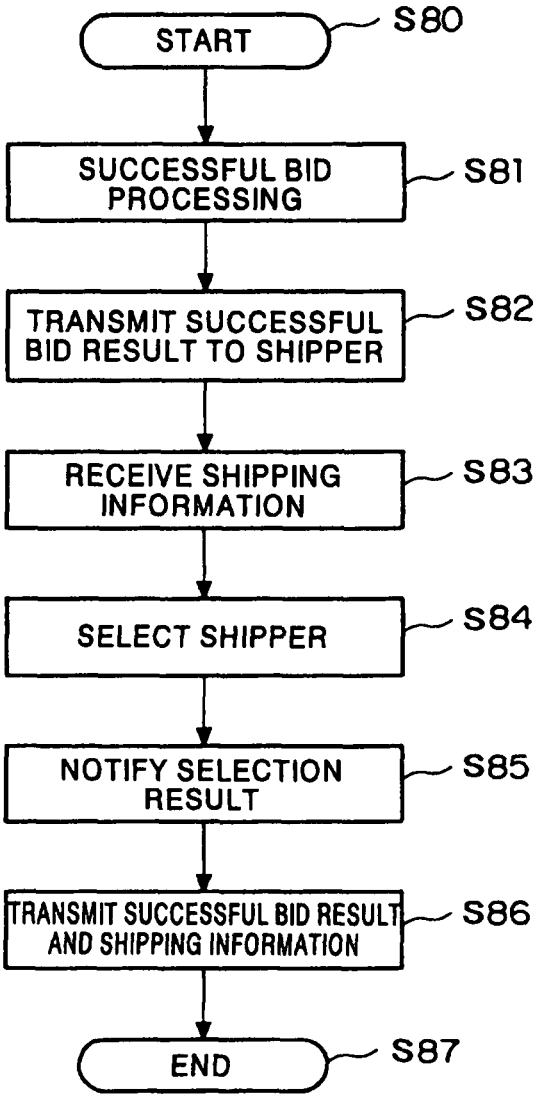
FIG. 13 is a flowchart for explaining processing of an auction processing unit and a shipping processing unit of the auction management device of the network auction system shown in FIG. 12.

FIG. 12 is also a view of the configuration of a network auction system 3 of the third embodiment.

The difference of this from the network auction system 2 of the second embodiment resides in that a plurality of shipping arrangement devices (shipper servers) 50 are provided.

The rest of the configuration of the network auction system and the hardware configurations of the auction management device 20*b*, client device 30, and the shipping arrangement devices 50 are the same as those of the first embodiment and the second embodiment, so the explanations thereof will be omitted.

Figure 10:
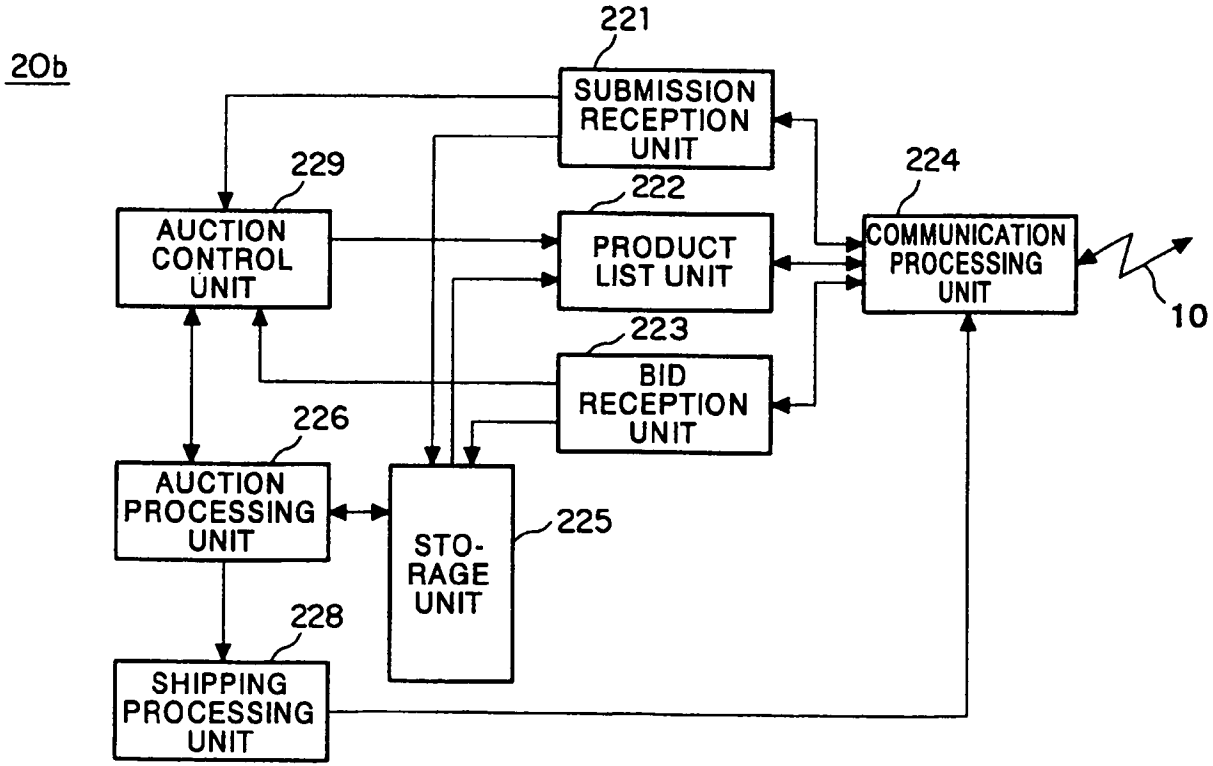
FIG. 10 is a block diagram of the configuration of an auction management device of the network auction system of the second embodiment of the present invention.
Figure 11:
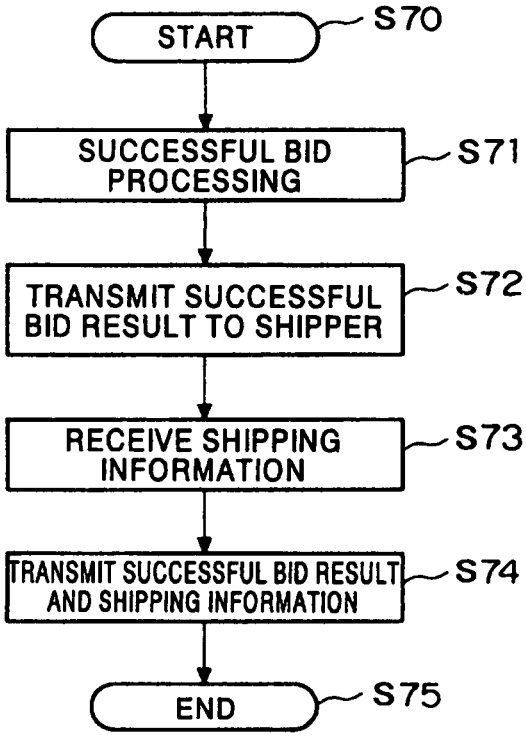
FIG. 11 is a flowchart for explaining processing of an auction processing unit and a shipping processing unit of the auction management device shown in FIG. 10.

In the configuration of the auction management device 20*b* shown in FIG. 10, only the processing in the shipping processing unit 228 is different. The configurations and processings of the other parts are the same as those of the second embodiment.

An explanation will be made of the parts of the processing of the shipping processing unit 228 different from the second embodiment by referring to FIG. 13.

The shipping processing unit 228 communicates with a plurality of shipping arrangement devices 50 relating to the successfully bid product based on the information input from the auction processing unit 226 relating to the successfully bid product and the submitter and successful bidder of that product, obtains the information relating to the shipping of the product from the shipping arrangement devices 50, selects one shipping arrangement device 50 for actually entrusting the shipping to based on the obtained information, notifies the result of selection to the shipping arrangement devices 50, and transmits the information relating to the shipping of the selected shipping arrangement device 50 together with the successful bid result to the submitting node device 31 and the successful bid node device 32.

A concrete explanation will be made of the processing of the shipping processing unit 228 by referring to FIG. 13.

First, when the period of the auction ends for a certain product, a series of processings is commenced (step S80), and the successful bid processing as mentioned above is carried out in the auction processing unit 226 (step S81).

Then, when the successful bid is established, the information relating to the product, submitter, and the successful bidder is input from the auction processing unit 226 to the shipping processing unit 228. Therefore the shipping processing unit 228 extracts the predetermined information required for insuring and shipping the product from this information and transmits the extracted information via the communication processing unit 224 to a plurality of shipping arrangement devices 50 (step S82).

As a result, the shipping arrangement devices 50 transmit information relating to the shipping such as the shipping fee and the delivery date and the information relating to the insurance such as the insurance fee. This is received via the communication processing unit 224 (step S83).

Then, when the information from the shipping arrangement devices 50 are assembled, the contents thereof are examined based on predetermined conditions, and one shipping arrangement device 50 for actually entrusting the shipping to is selected (step S84). In the third embodiment, the shipper (shipping arrangement device 50) presenting the lowest total cost of the shipping fee and insurance fee and other miscellaneous expenses such as packing costs is selected.

When the shipping arrangement device 50 is selected, the result of the selection is notified to all shipping arrangement devices 50 (step S85), and the required information is extracted from the information of shipping from the selected shipping arrangement device 50 and the result of successful bid input from the auction processing unit 226 and transmitted to the submitter and the successful bidder (step S86), whereby the series of processing after determination of the successful bid is ended (step S87).

In the network auction system 3 of the third embodiment having such a configuration, in addition to effects similar to those by the second embodiment mentioned above, the shipper presenting the cheapest shipping cost can be selected from among a plurality of shippers, so the shipping processing after the successful bid becomes more preferred in format.

As a result, it becomes easy to participate in an auction, network auctions are stimulated, and product transactions via network auctions can be stimulated.

Fourth Embodiment

An explanation will next be made of a fourth embodiment of the present invention by referring to FIG. 14.

In the fourth embodiment, the present invention will be explained with reference to a case where the shipping arrangement device 50 provides information relating to the shipping considering also the delivery and retrieval of the packing material.

Figure 14:
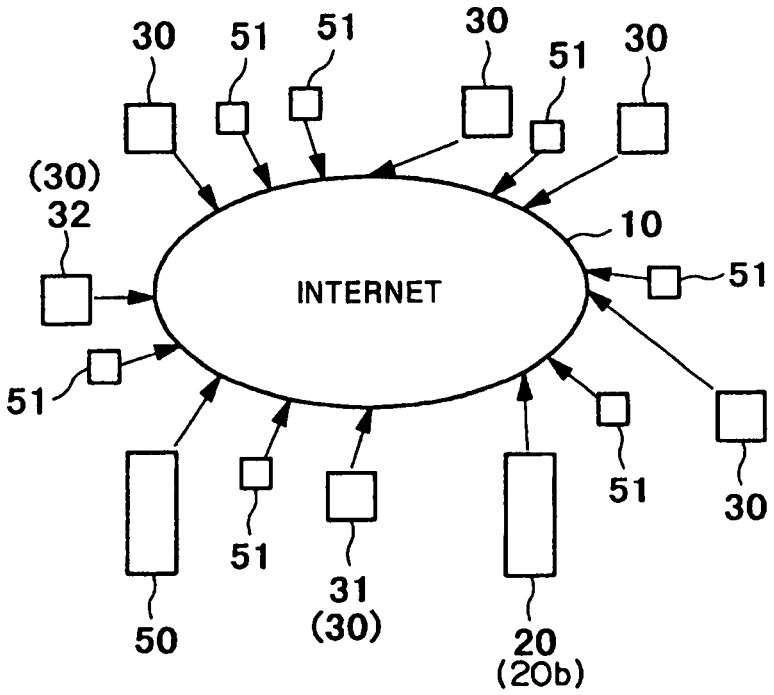
FIG. 14 is a block diagram of the configuration of a network auction system of a fourth embodiment of the present invention.

The configuration of a network auction system 4 of the fourth embodiment is shown in FIG. 14.

The network auction system 4 is configured, as shown in FIG. 14, by the auction sponsor server 20, client device 30, shipper server 50, and shipping terminals 51 corresponding to branches of the shipper having the shipper server 50 connected by the network 10.

A shipping terminal 51 is a terminal originally connected to the shipper server 50 and used for management of the shipped goods, management of the shipping work, etc. of the shipper per se. It is disposed in branches (workplaces) of the shipper existing at many places around the World.

In the network auction system 4 having such a configuration, the configurations and operations of the auction management device 20*b* and the client device 30 are the same as those of the second embodiment. Only the processing of the shipper server 50 is different. Therefore, the processing of the shipper server 50 will be explained below.

In the network auction system 4, the shipping arrangement device 50 performs the arrangements for shipping of a product in response to an inquiry from the auction sponsor server 20 and transmits the information relating to the shipping to the auction management device 20*b* in the same way as the case of the second embodiment.

Then, further, it instructs the shipping terminal 51 of the branch nearest the submitter to deliver packing material suitable for the product to the submitter.

Also, it instructs the shipping terminal 51 of the branch nearest the successful bidder to quickly retrieve the packing material used for the shipping after the end of the shipping.

As mentioned above, the shipping arrangement device 50 is sent information relating to the submitter and the successful bidder and information indicating the size, shape, weight, material, and structure of the product, precautions in handling, etc. from the auction management device 20*b*.

Accordingly, the shipper server 50 detects the branches nearest the submitter and the successful bidder based on the information and detects the packing material best suited for packing that product.

In the network auction system 4 having such a configuration, when the successful bid is determined in the auction, the shipping processing unit 228 transmits the information of that product, the information of the submitter of that product, and the information of the successful bidder to the shipping arrangement device 50 via the communication processing unit 224.

By this, the shipping arrangement device 50 calculates the costs including the shipping fee and the insurance fee, makes the actual arrangements of the shipping for shipping that product from the submitter to the successful bidder, returns the information such as the cost and delivery date to the shipping processing unit 228, detects the shipping terminal 51 near the submitter, and arranges the delivery of the packing material.

The shipping processing unit 228 adds the information relating to the shipping transmitted from the shipping arrangement device 50 to the information of the successfully bid product, submitter, and the successful bidder as the information of the result of the successful bid and notifies the same to the submitter and the successful bidder as the result of the auction.

As a result, the submitter not only receives the successful bid result with the arrangement of shipping and information added thereto, but also has delivered to it the packing material suited to that product.

In this way, in the network auction system of the fourth embodiment, it also becomes unnecessary for the submitter to make arrangements for the packing material, so the work becomes easier.

Also, the packing material suited to the product is delivered to the submitter and retrieved from the successful bidder. Therefore, at both sides, a large amount of garbage relating to the packing can be prevented, so a transaction of a product in a manner conserving natural resources and not having an impact on the environment becomes possible.

Fifth Embodiment

An explanation will next be made of a fifth embodiment of the present invention by referring to FIG. 15 to FIG. 21.

In the fifth embodiment, the present invention will be explained with reference to a network trial system.

Figure 15:
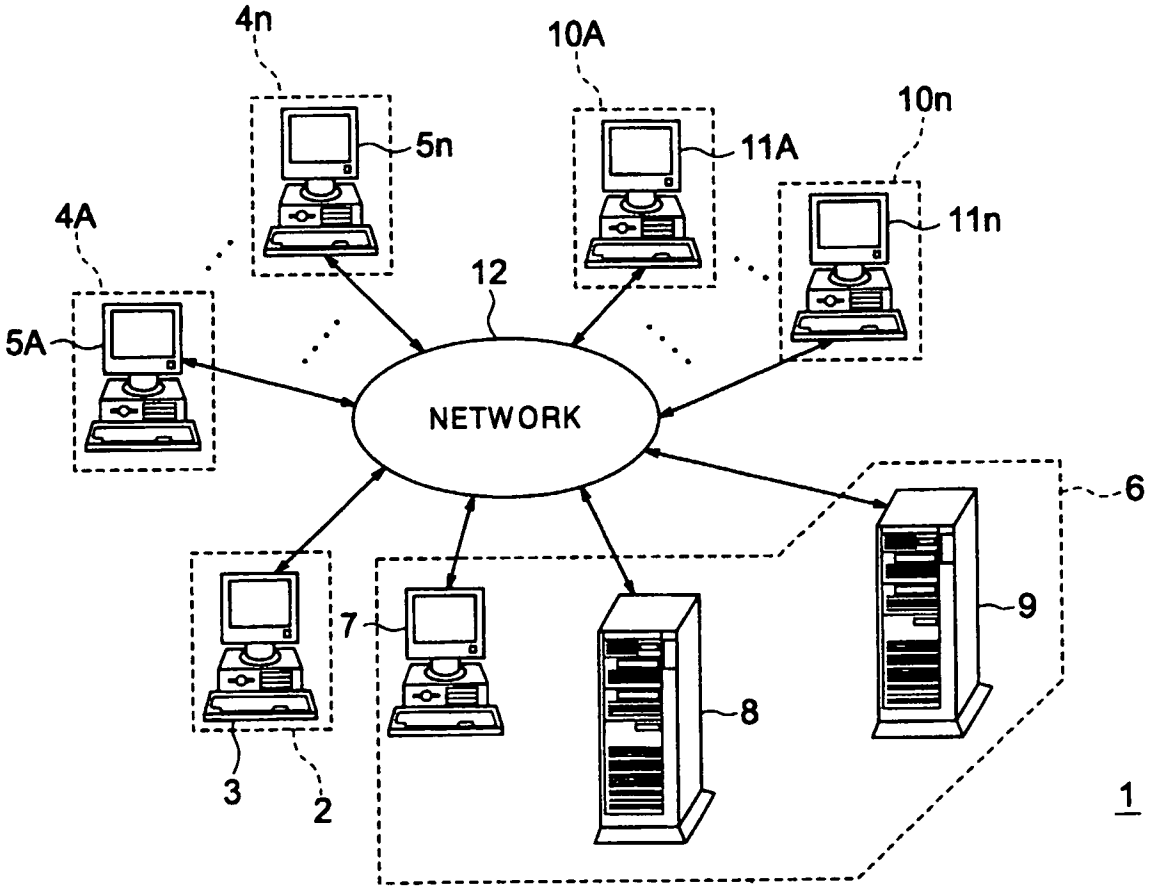
FIG. 15 is a schematic view of the configuration of a network trial system according to a fifth embodiment.

As shown in FIG. 15, a network trial system 5 is comprised by a HTTP (Hypertext Transport Protocol) server 63 owned by a vendor 62, a plurality of client computers 65A to 65*n* owned by users 64A to 64*n*, an insurance server 67 an evidence registration server 68, and a trial server 69 owned by an insurance company 66, and a plurality of personal computers 71A to 71*n* owner by jurors 70A to 70*n* connected to each other via a network 61 comprised by the Internet or the like.

The HTTP server 63 is a web server for performing various processing when selling products on the network 61. It can transmit screen data such as a web page listing the product information to the client computers 65A to 65*n* or the like accessed via the network 61 or perform settlement processing at time of sale of a product.

The client computers 65A to 65*n* are usual personal computers installed in homes of the users 64A to 64*n* or the like and can communicate with the HTTP server 63, insurance server 67, evidence registration server 68, or trial server 69 via the network 61 to transmit and receive the required data.

The insurance server 67 is a web server for performing the overall management of the insurance server as will be mentioned later (network trial insurance service) and is designed so as to be able to perform the processing when the users 64A to 64*n* and vendor 62 subscribe to the insurance and the processing when managing the personal information of the insured person and paying out insurance.

The evidence registration server 68 is a web server having a large capacity data storage device and is comprised so as to be able to store the required data and transmit the stored data via the network 61 to the trial server 69, specific client computers 65A to 65*n* permitted in advance, the HTTP server 63, personal computers 71A to 71*n*, etc.

Also, the trial server 69 is a web server playing a central role when conducting a trial on the network 61 (hereinafter, this will be referred to as a "network trial") by a jury format as will be explained later in response to accusations from the users 64A to 64*n*. It is designed so as to be able to perform various processing, for example, election of the jurors 70A to 70*n* for each case and rendering of a judgement by combining the opinions of the jurors 70A to 70*n* on that case based on a program loaded in advance.

Figure 16:
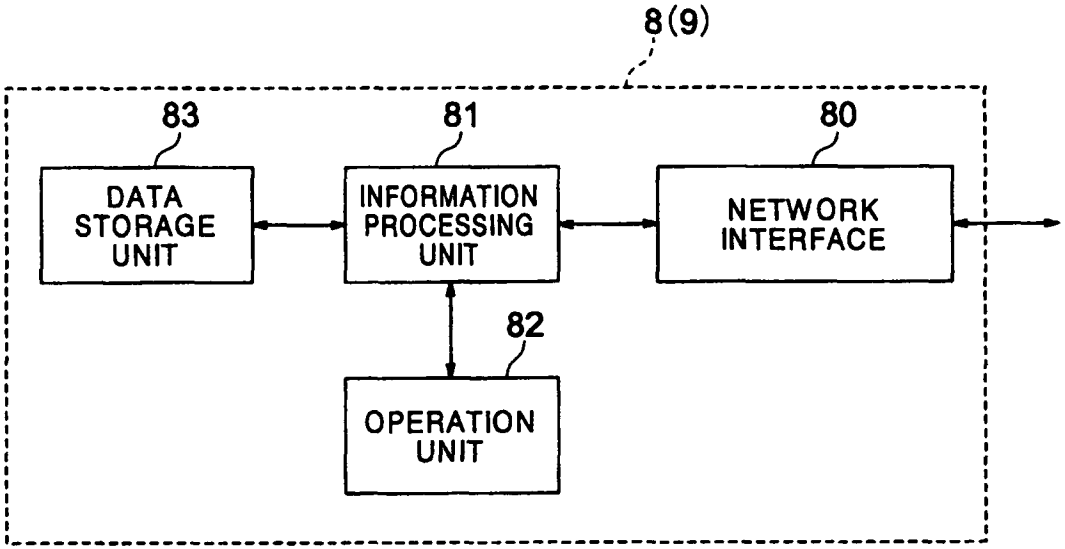
FIG. 16 is a block diagram of the configurations of an evidence registration server and a trial server.

FIG. 16 shows the configurations of the evidence registration server 68 and the trial server 69 in this network trial system 5.

As apparent also from FIG. 16, the evidence registration server 68 and the trial server 69 are each comprised by a network interface unit 80, information processing unit 81, operation unit 82, and data storage unit 83 and are each connected to the network 61 via the network interface unit 80.

In these evidence registration server 68 and trial server 69, the data and commands supplied via the network 61 from the HTTP server 63, client computers 65A to 65*n*, personal computers 71A to 71*n*, etc. can be fetched into the information processing unit 81 via the network interface unit 80.

The information processing unit 81 is configured as a microcomputer having a CPU (central processing unit), ROM (read only memory), and RAM (random access memory) and executes predetermined processing based on commands fetched via the network interface unit 80, various programs stored in the ROM in advance, and the instructions of the operator input via the operation unit 82 comprised by a mouse, a keyboard, or the like.

The information processing unit 81 is comprised so as to give the data fetched via for example the network interface unit 80 at this time to the data storage unit 83 for storage, read the required data stored by the data storage unit 83, and transmit this to the corresponding client computers 65A to 65*n* and the personal computers 71A to 71*n* or the like sequentially via the network interface unit 80 and the network 61.

Next, a brief explanation will be made of a network trial in the network trial system 5.

In this network trial system 5, when users 64A to 64*n* purchase products from the vendor 62 on the network 61 by using the client servers 65A to 65*n*, the screen data or the like of the web page giving the information of the product is stored in the evidence registration server 68 so as to register the information of the product presented by the vendor 62 in advance as evidence.

Then, thereafter, when trouble arises, for example the vendor 62 will not accept returns or make exchanges in spite of the fact that products shipped from the vendor 62 are scratched or stained or the products are different from the product information at the time of purchase, and the trouble cannot be solved by discussions between the users and the vendor 62, the users 64A to 64*n* raise a suit (make an accusation) by transmitting petition data to the trial server 69 via the client computers 65A to 65*n*.

When receiving petition data, the trial server 69 collects the various required evidence information on the case from the concerned parties etc. via the network 61. Also, the trial server 69 selects a plurality of jurors 70A to 70*n* for that case together with this and transmits the registration numbers of the screen data of the web page in the evidence registration server 68 and various evidence information collected via the network 61 as mentioned above as the case data to these selected jurors 70A to 70*n*.

Then, the selected jurors 70A to 70*n* judge the amount of settlement to the users 64A to 64*n* acting as the plaintiffs in the case (hereinafter, they will be simply referred to as the "plaintiff") based on the case data transmitted from the trial server 69, screen data of the web page registered in the evidence registration server 68, and so on and transmits the result of the decision as the decision data via the personal computers 71A to 71*n* to the trial server 69.

The trial server 69 determines the amount of insurance (amount of settlement) to the plaintiff based on the decision data supplied from the jurors 70A to 70*n*, publishes the result of the determination as the judgement on the network 61 and, at the same time, sends the same as the judgement data to the insurance server 67.

The insurance server 6 judges to pay the insurance (settlement) in accordance with the judgement to the plaintiff by for example electronic money according to the judgement data when the judgement data is given from the trial server 69.

In this way, in this network trial system 5, trouble due to commercial transactions on the network 61 can be quickly solved by the trial method using the network 61.

Below, a detailed explanation will be made of the network trial.

First, an explanation will be made of the conditions for use of the network trial system 5.

Here, in this network trial system 5, both of the plaintiff side and the defendant, that is, the vendor 62 (hereinafter this will be simply referred to as the "defendant") subscribing the insurance for e-commerce transactions sold by the insurance company 66 (hereinafter this will be simply referred to as the "network trial insurance") is a condition for usage of this network trial. The premiums paid by the subscribers to the insurance are pooled as resources for payment of settlements to the plaintiff after judgements.

Parties can subscribe to this network trial insurance by accessing the insurance server 67 via the network 61 by using personal computers such as client computers 65A to 65*n* to notify the required information such as their names and e-mail addresses and paying the subscriber registration fees by electronic money or credit. Insurance registration numbers are given to the subscribers from the insurance server 67.

Also, in this network trial system 5, a predetermined icon representing this (hereinafter, this will be simply referred to as an "insurance icon"), the insurance registration number, etc. are displayed on the web page of the vendor 62 subscribing to the network trial insurance while linked to the site of the insurance server 67.

The users 64A to 64*n* can connect the client computers 65A to 65*n* to the insurance server 67 by clicking on this insurance icon to investigate if the vendor 62 has legitimately subscribed to the network trial insurance based on the insurance registration number displayed on the web page.

Figure 17:
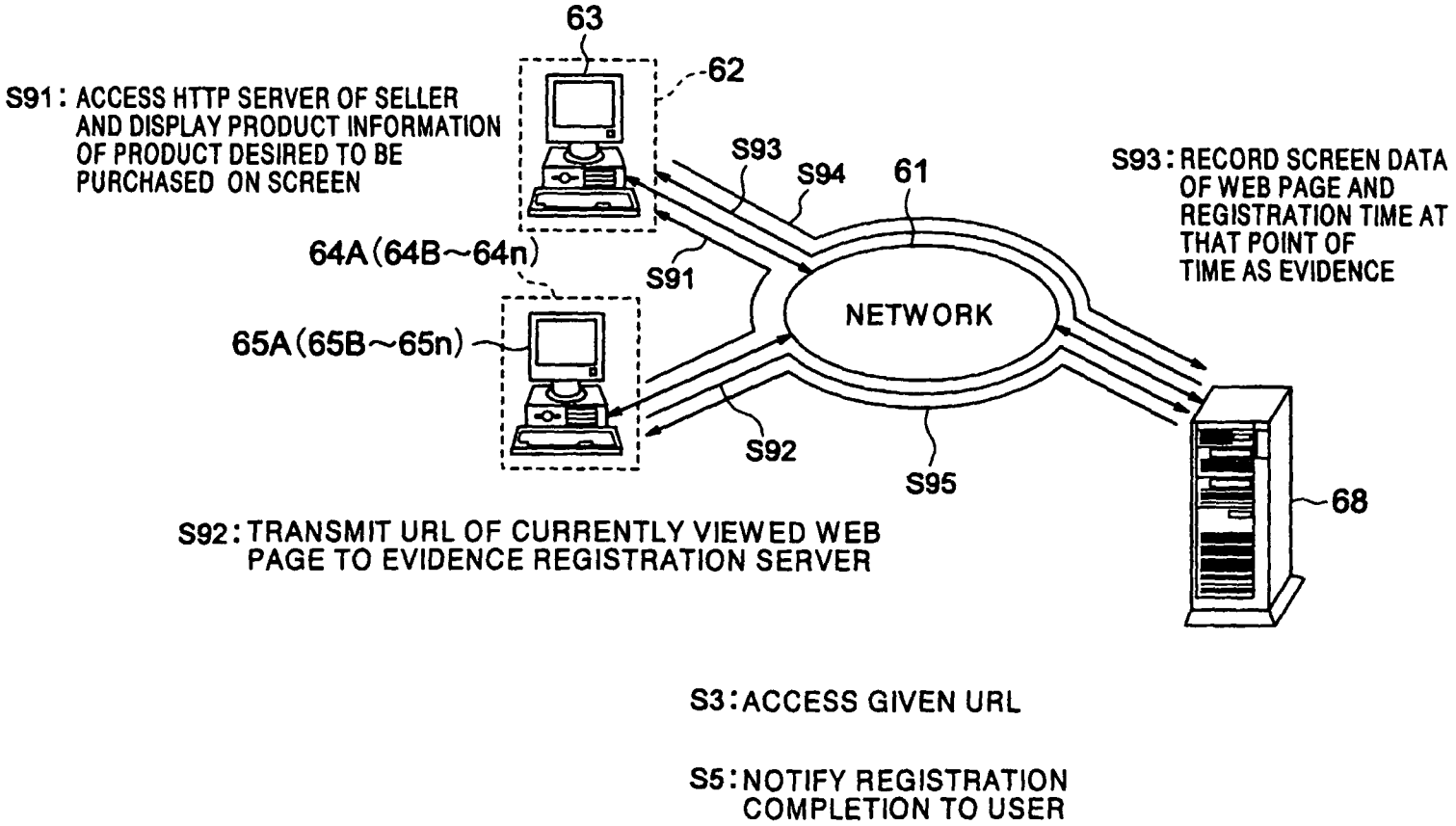
FIG. 17 is a schematic view provided for explanation of a routine for registration of evidence.

Next, an explanation will be made of the routine for registration of evidence to the evidence registration server 68 in this network trial system 5 by using FIG. 17.

The users 64A to 64*n* access the HTTP server 63 of the vendor 62 when purchasing products from the vendor 62 on the network 61, call up the web page providing the information of the products to be purchased on the display of their client computers 65A to 65*n* (step S91), and start up a program for URL transfer in this state so as to notify the URL of the web page from the client computers 65A to 65*n* via the network 61 to the evidence registration server 68 by e-mail (step S92).

At this time, when receiving the e-mails, the evidence registration server 68 checks if the users 64A to 64*n* of the client computers 65A to 65*n* of the transmitting side of the e-mails are persons subscribing to the network trial insurance based on the addresses of the transmitting sides of the e-mails. When they are subscribed, it accesses the notified URL (step S93) and stores the thus obtained screen data of the web page together with the date and time (step S94). By this, the evidence registration server 68 registers the screen data of the web page viewed by the users 64A to 64*n* at this time as evidence.

Note that the client computers 65A to 65*n* are also loaded with a program for automatically transferring the e-mails sent from the vendor 62 to the evidence registration server 68. Thus, the product information etc. sent from the vendor 62 by e-mail are also registered in the evidence registration server 68 as evidence.

When the users 64A to 64*n* register the evidence in the evidence registration server 68 in this way, e-mails informing them of the completion of registration and the evidence registration numbers as the registration numbers of the evidence are sent from the evidence registration server 68 to the users 64A to 64*n* (step S95). By this, the users 64A to 64*n* can hold required evidence based on the evidence registration numbers.

Incidentally, the evidence registration server 68 is provided with the function of checking various stored data by the registration dates and automatically deleting data after a predetermined period so as to prevent accumulation of meaningless data.

Next, an explanation will be made of the method of accusation and the processing of the trial server 69 at the time of accusation.

Figure 18:
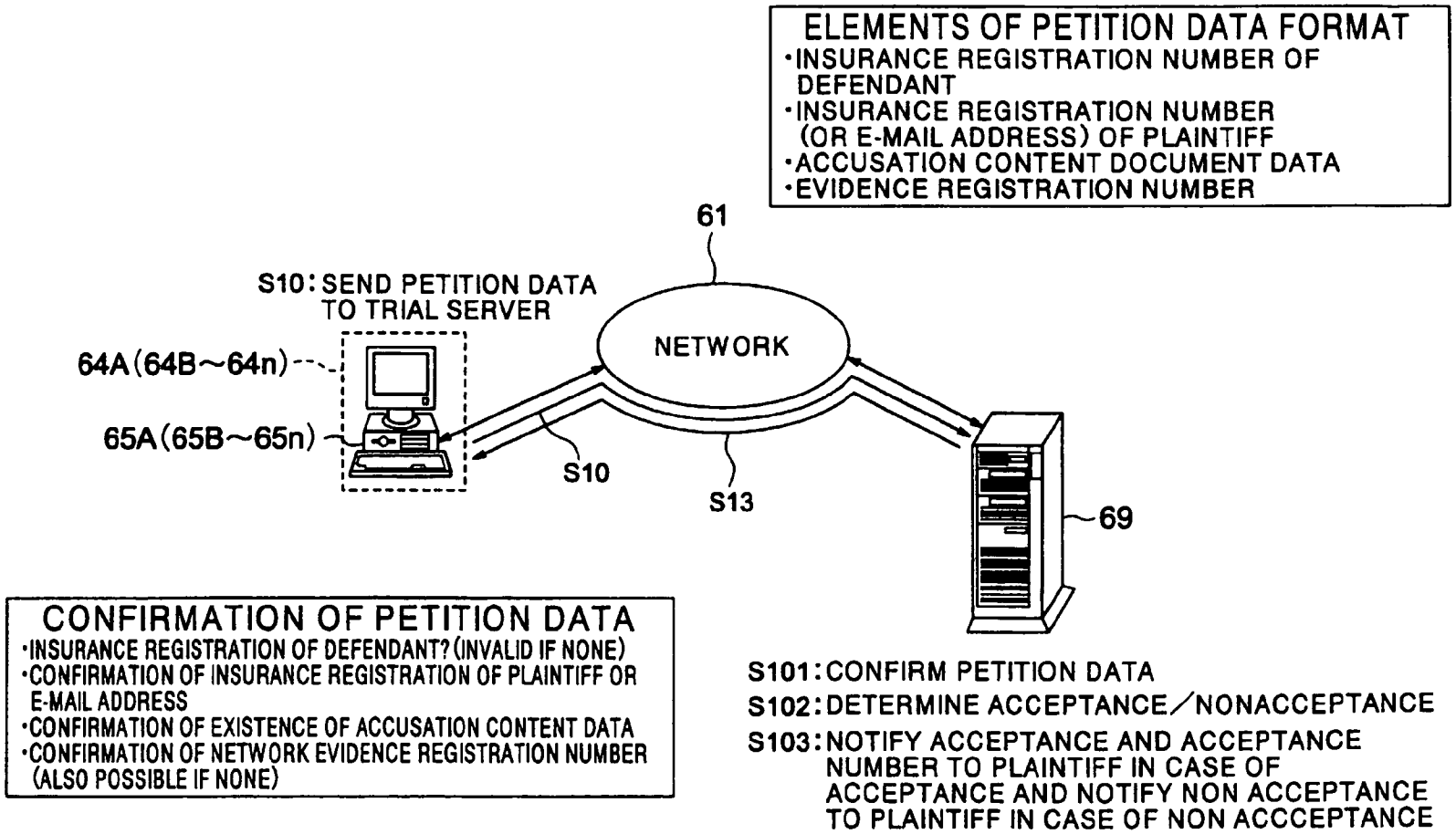
FIG. 18 is a schematic view provided for explanation of a method of accusation and processing of the trial server at the time of accusation.
Figure 19:
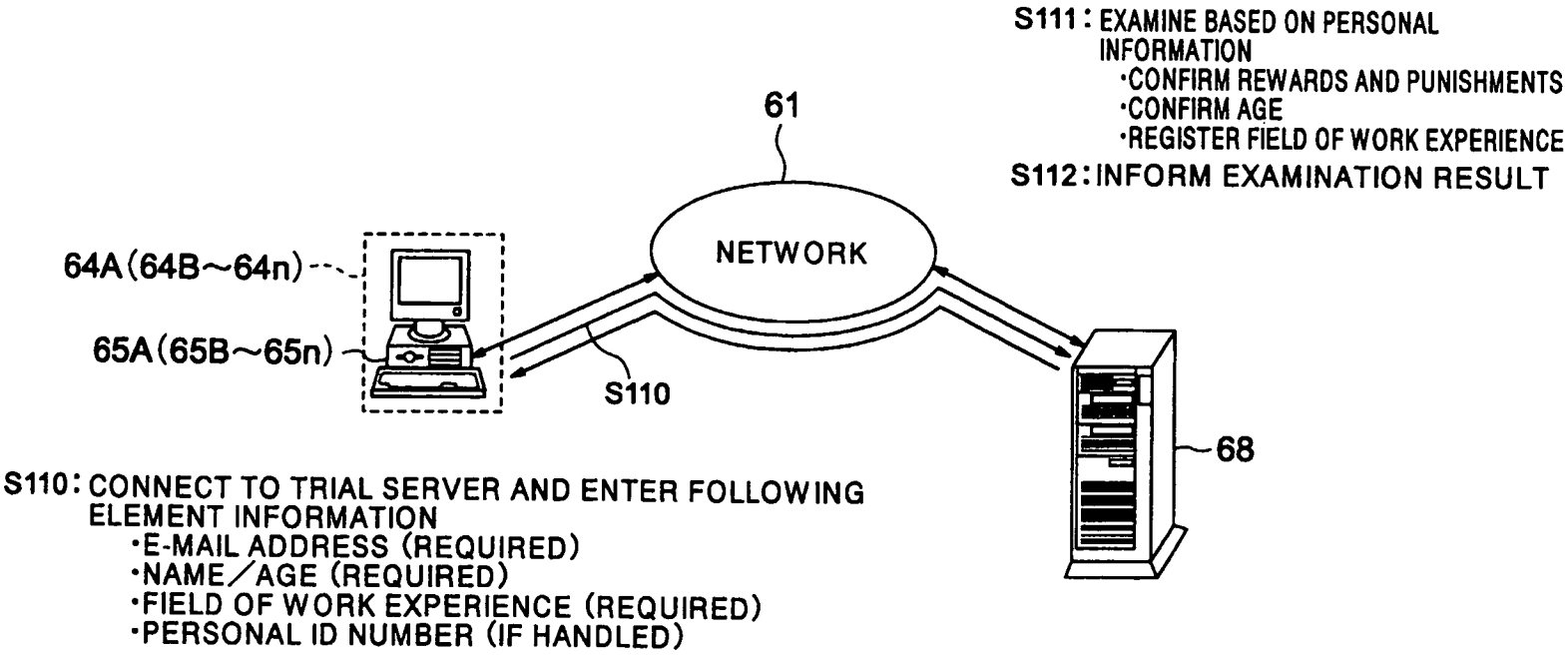
FIG. 19 is a schematic view provided for explanation of the routine for registration of jurors.

When trouble occurs in a commercial transaction on the network 61 as mentioned above and the problem cannot be solved by discussions with the vendor 62, the users 64A and 64*n* make an accusation by transmitting petition data of a predetermined format to the trial server 69 as shown in FIG. 18 (step S100).

In this case, the petition data includes the insurance registration number of the defendant, that is, vendor 62, the insurance registration numbers and/or e-mail addresses of the plaintiffs, that is, the users 64A to 64*n*, the content of the accusation, that is, the accusation content data, the code number of the case field, that is, the case field code, the evidence registration numbers, etc.

When receiving the petition data, the trial server 69 first confirms if the defendant is a party subscribed to the network trial insurance, confirms the insurance registration numbers and/or e-mail addresses of the plaintiffs, confirms the existence of the accusation content data, confirms the case field code, confirms the network evidence registration number (note, this is not an essential requirement), and so on (step S101) and determines whether or not it accepts the suit (whether or not it receives the petition data) based on the results of confirmation (step S102).

Concretely, the trial server 69 does not accept the petition data when for example the data of essential requirements (insurance registration number of the defendant, insurance registration numbers and/or mail addresses of plaintiffs, accusation content data, case field code, etc.) is missing in the petition data or neither of the defendant and plaintiffs subscribe to the network trial insurance, while accepts the petition data in cases other than this.

Then, when accepting the petition data, the trial server 69 notifies an acceptance number of the accusation to the plaintiff by e-mail or another method, while when not accepting the petition data, notifies this fact to the plaintiff (step S103).

Next, an explanation will be made of the process of the juror registration.

In this network trial system 5, jurors 70A to 70*n* are solicited from among general citizens. Persons satisfying certain conditions are registered as the jurors from among the applicants.

In this case, the applicants for juror registration access the trial server 69 via the network 61 by using for example their personal computers and enter their required personal information such as e-mail addresses, names, ages, codes representing work experience fields (hereinafter, this will be referred to as "work experience field codes"), and existence of any rewards and punishment in the corresponding entry fields of the web page for juror registration applicants displayed on the displays at this time (step S110).

The trial server 69 judges based on the thus obtained personal information whether or not each applicant satisfies the conditions as a juror set in advance from the existence of rewards and punishment, age, work experience, etc. (step S111).

The trial server 69 registers the applicant as a juror when this applicant satisfies the conditions, then sends an e-mail informing the registration as the juror to the applicant, while notifies the applicant of not having passed the examination by e-mail where he does not satisfy the conditions (step S112).

Next, an explanation will be made of the election of the jurors 70A to 70*n*.

Figure 20:
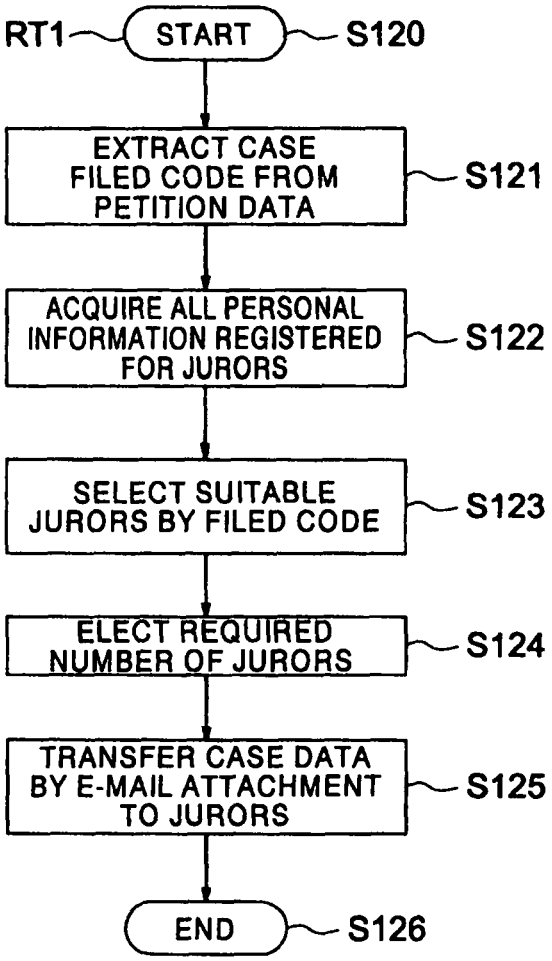
FIG. 20 is a flowchart showing a routine for processing for election of jurors.

When receiving the petition data, the trial server 69 collects various evidence information for the case via the network 61 from the concerned parties etc. as mentioned above, and then elects the jurors 70A to 70*n* for that case from among the persons registered as jurors according to a juror election processing routine RT1 shown in FIG. 20.

Namely, after receiving the accusation data, when the processing for collection of the required evidence information ends, the trial server 69 starts this juror election processing routine RT1 at step S120 and extracts the case field code from the petition data at the subsequent step S121.

Then, the trial server 69 proceeds to step S122 where it accesses the insurance server 67 to acquire the personal information of all persons registered as the jurors and, at the subsequent step S123, selects the persons satisfying predetermined conditions, for example having work experience of the case field of that case, based on the acquired personal information of each person and the case field code extracted at step S121.

Further, the trial server 69 proceeds to step S124 where it elects a predetermined number of persons from among persons selected at step S123 at random as jurors for that case.

Then, at the subsequent step S125, the trial server 69 notifies the elected jurors 70A to 70*n* by the e-mail of the fact that they were elected as the jurors of that case, the evidence registration numbers for the case, accusation content data, various evidence information collected on the network 61 as mentioned above, and so on as the case data, then proceeds to step S126, where it terminates this juror election processing routine RT1.

Next, an explanation will be made of the decision by the jurors 70A to 70*n*.

The jurors 70A to 70*n* elected as mentioned above first access the evidence registration server 68 and extracts the evidence data for that case based on the notified evidence registration numbers.

Then, the jurors 70A to 70*n* decide the amount of settlement to the plaintiffs based on this extracted evidence data, transmitted accusation content data, and other various evidence information and transmit the results of their decisions as the decision data to the trial server 69.

Next, an explanation will be made of the processing for rendering a judgement and executing a judgement.

Figure 21:
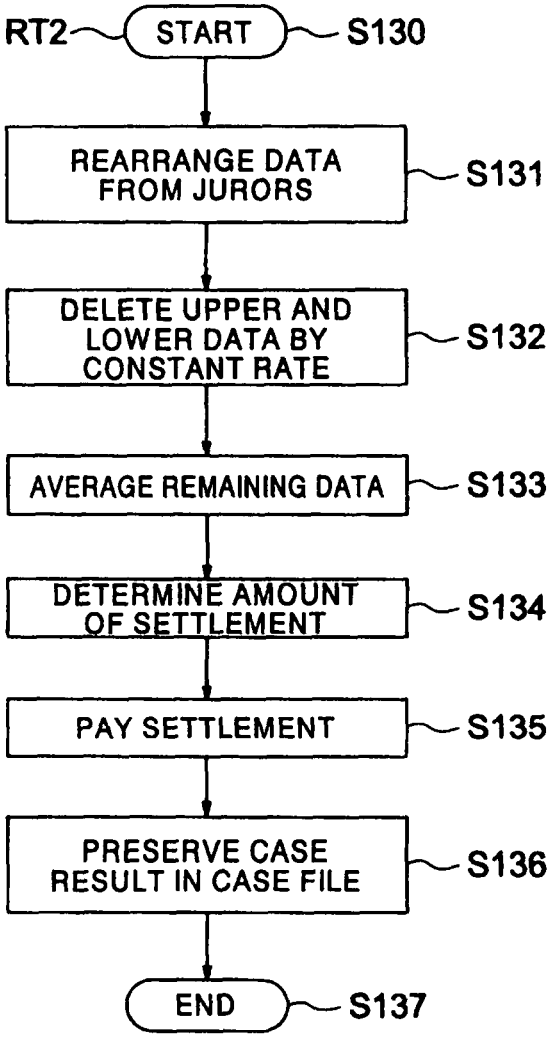
FIG. 21 is a flowchart showing a routine for processing for rendering a judgement and executing a judgement.

When the decision data are given from all jurors 70A to 70*n* elected for that case, the trial server 69 renders the judgement for that case according to the judgement rendering and the judgement executing processing routine RT2 shown in FIG. 21 based on these all decision data and renders a judgement so as to pay insurance (compensation) to the plaintiffs based on the judgement according to need.

Namely, when the decision data are transmitted from all jurors 70A to 70*n* elected for that case, the trial server 69 starts this judgement rendering and judgement executing processing routine RT2 at step S130, rearranges the data of the jurors at the subsequent step S131, and deletes the settlement amounts decided by individual jurors 70A to 70*n* by a constant rate at step S132. This is done for avoiding extreme decisions from being reflected in the judgement.

Then, the trial server 69 proceeds to step S133 at which it averages the remaining amounts of settlement decided by the jurors 70A to 70*n*, then proceeds to step S134 at which it determines the amount of insurance (amount of settlement) for the plaintiffs based on this result and renders a judgement.

Then, the trial server 69 proceeds to step S135, at which it sends electronic money of the amount of the insurance (amount of settlement) determined at step S134 to the plaintiffs or remits an amount of money corresponding to the settlement to the account of financial institutions of the plaintiffs.

Further, at the subsequent step S136, the trial server 69 registers various information concerning that case such as the judgement of the case, results of decisions by the jurors 70A to 70*n*, accusation content based on the petition data and screen data registered in the evidence registration server 68, and various evidence information collected by the trial server 69 on the network 61 in the case file in a predetermined format, then proceeds to step S137, at which it end this judgement rendering and judgement executing processing routine RT2.

Next, an explanation will be made of the operation of the network trial system 5.

In the above configuration, the users 64A to 64*n* register the product information of the product as evidence in the evidence registration server 68 in advance when purchasing the products from the vendor 62 via the network 61, then, when trouble arises with the vendor 62 for those commercial transactions, make accusations by transmitting the petition data to the trial server 69.

Then, when receiving this petition data, the trial server 69 elects the jurors 70A to 70*n* for this case and transmits the required case data to these elected jurors 70A to 70*n*. Also, the elected jurors 70A to 70*n* render judgements based on the case data and notify the decisions as the decision data to the trial server 69.

Further, the trial server 69 renders the judgement of this case based on the decision data notified from the jurors 70A to 70*n* and pays the insurance (settlement) in accordance with the determination results via the insurance server 67 to the users 64A to 64*n*.

In this way, according to the network trial system 5, for example, only a few days are taken from the accusation to the solution of the problem (from the judgement to the payment of the insurance). Also, no cost is required for solving the trouble other than the premiums for the network trial insurance. Therefore, it is possible to deal practically with a low compensation problem and possible to eliminate anxieties of the users 64A to 64*n* when using the sale service and therefore improve the stability of the sale service.

Also, according to such a network trial, general citizens can participate as the jurors 70A to 70*n*, therefore a judgement in which the feelings of the public are reflected can be obtained and a further feeling of safety regarding the sale service can be given to the users 64A to 64*n*. Also, it is possible to cope with international e-commerce spanning countries having different judicial systems.

Also, according to the above configuration, by conducting the trial on the network 61, a shortening of the trial period and a reduction of the trial cost can be achieved. Thus, a network trial system capable of improving the feeling of safety and stability of a sale service can be realized.

Modification

Note that the present invention is not limited to the first to fifth embodiments and may be modified in various ways.

For example, in the first embodiment, the method of auction of the minimum reserve designation system wherein one product was submitted was exemplified, but the present invention is not limited to this. For example, the present invention can also be applied to an auction referred to as a "Dutch auction" where there are a plurality of products.

Figure 4:
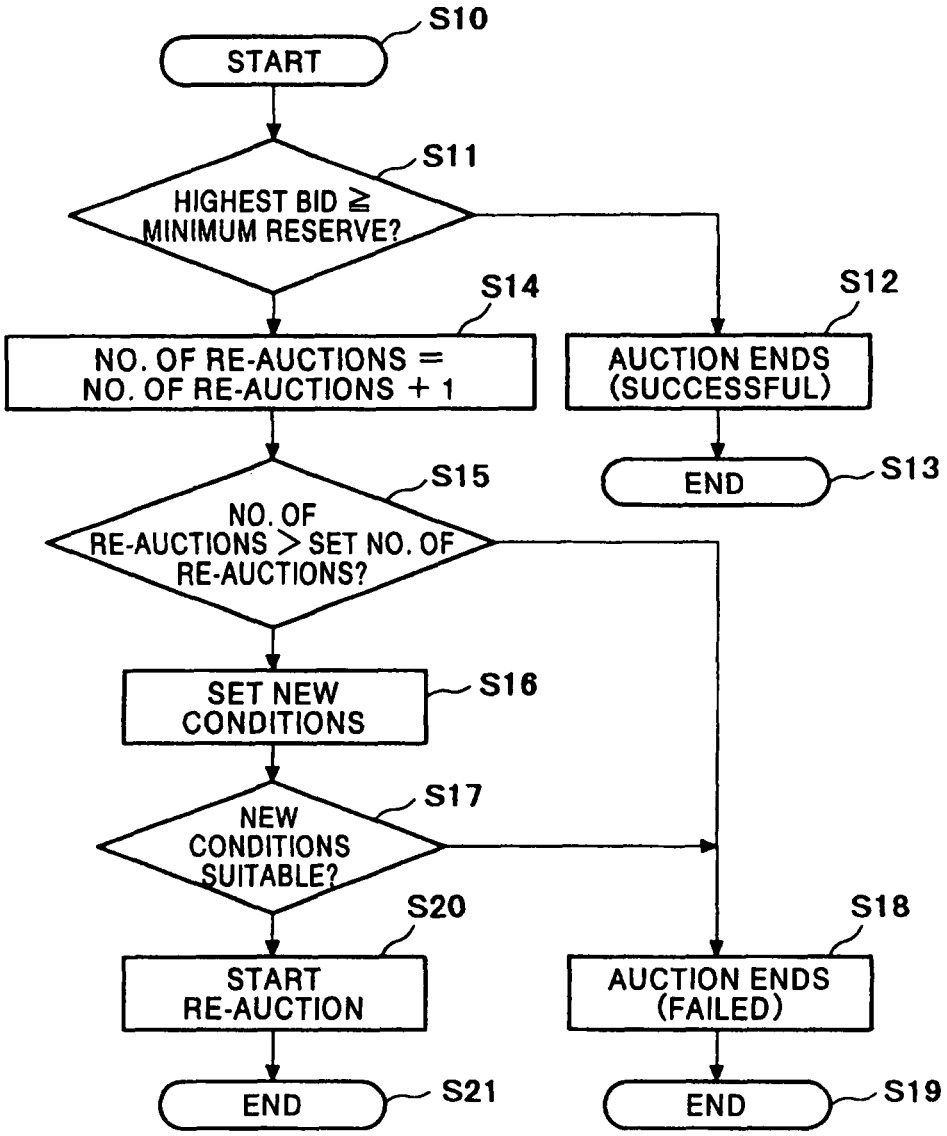
FIG. 4 is a flowchart for explaining processing in an auction processing unit and a re-auction control unit of the auction management device shown in FIG. 3.

Also the processing relating to the re-auction in the first embodiment is not limited to the routine shown in FIG. 4. For example, the processing of restricting the number of re-auctions by a set maximum number or the processing of examining whether or not the changed new conditions are adequate are carried out, but even without these processing, there is no change in the gist of the present invention. Also the method of changing the minimum reserve is not limited to the three concrete examples mentioned above. The reserve can be changed by any method.

Also, the second to fourth embodiments were configured with the information relating to the shipping of the product obtained by the auction management device 20*b* inquiring at the shipping arrangement device 50. However, if the auction management device 20*b* per se stores the information of the shipping fee and insurance fee based on the locations of the shipping side and the destination of the shipping, the size and weight of the product, etc. in for example the storage unit 225, the successful bid result can be transmitted to the submitter and the successful bidder in a form plus the information relating to the shipping of the product without inquiring outside. Such a configuration is also within the scope of the present invention.

Also, in the second to fourth embodiments, the information relating to the shipping from the shipping arrangement device 50 was once transferred to the shipping processing unit 228 of the auction management device 20*b* and then transferred to the submitter and the successful bidder from the auction management device 20*b*. However, a configuration wherein these information relating to the shipping are directly transmitted to the submitter and the successful bidder from the shipping arrangement device 50 separately from the notification of the successful bid result can also be employed.

Also, where one shipping arrangement device 50 is selected based on the information obtained from a plurality of shipping arrangement devices 50 as in the third embodiment, the standard used for the selection may be any standard. Any standard, for example a degree of flexibility of the shipping period, pickup date, and delivery date and time, quality of packing, and transporting means can be used other than the standard of total cost as in the third embodiment. Also, only the basic conditions of the shipping may be indicated and the shipper selected by auction by the shippers, or the submitter and successful bidder can select the shipper by viewing the information.

Also, the information relating to the successful bid result to be transmitted from the auction management device 20*b* to the shipping arrangement device 50, information relating to the shipping provided by the shipping arrangement device 50, and other information in the second to fourth embodiments may be any information.

Also, in the second to fourth embodiments, the shipping arrangement device 50 performed the processing up to the arrangement of the shipping, but desirably this is finally, performed after obtaining the confirmation of the submitter, so first only the information of the shipping fee or the like may be notified.

Also as the method of auction performed in the network auction system of the present invention, in the second to fourth embodiments, the case of the minimum reserve designation system and one submitted product was exemplified, but the present invention is not limited to this. For example, an auction referred to as a "Dutch auction" wherein there are a plurality of products is also possible. Any system of auction can be employed.

Also, the network comprising the network auction systems 1 to 4 of the first to fourth embodiments is not limited to the Internet and may be any wide area or local network.

Also, the hardware configurations of the auction sponsor servers, client devices, and shipper servers and functional block configurations of the auction management devices of the first to fourth embodiments are not limited to the configurations as shown in the embodiments and may be any configurations.

Also, in the fifth embodiment, a description was made of the case where the present invention was applied to insurance for solving trouble concerning a sale service where a purchaser purchasing a desired product by accessing the seller side via the network and viewing the product information, but the present invention is not limited to this and can be widely applied to also insurance for various types of services provided on a network other than this and further to actual trials based on the judicial system of the country in question.

Also, in the fifth embodiment, the description was made of the case where the evidence registration server 68 serving as the storage means for storing the required information in the service provided on the network as evidence information and the trial server 69 serving as the receiving means for receiving the petition information (petition data in the fifth embodiment) and as the judging means for rendering a judgement with respect to the suit based on the petition information on the basis of the petition information and evidence information (screen data and e-mail data of the web page in the fifth embodiment) were comprised as in FIG. 16, but the present invention is not limited to this. Various configurations other than this can be widely applied.

Further, in the fifth embodiment, the description was made of the case where the evidence registration server 68 and the trial server 69 were separately formed, but the present invention is not limited to this. They can be integrally constructed as one device too. Also, in the fifth embodiment, the description was made of the case where the receiving means for receiving the petition information and the judging means for rendering a judgement with respect to a suit based on the petition information on the basis of the petition information and evidence information were constructed as one device (trial server 69), but the present invention is not limited to this. It is also possible to construct them as different devices.

Further, in the fifth embodiment, the description was made of the case where the judgement was rendered by the juror system, but the present invention is not limited to this. It is also possible to render a judgement by software by the trial server 69 based on the petition data and various evidence information for the case collected via the network and possible to render a judgement by a person determined as a judge (for example, a staff of the insurance company) based on the petition data and various evidence information.

Further, in the fifth embodiment, the description was made of the case where the function as the means for executing a judgement was provided at the insurance server 67, but the present invention is not limited to this. It is also possible to provide this function at the trial server 69.

In this way, according to the present invention, in a network auction, it becomes possible to easily perform re-auction in the case of failure to establish a transaction. As a result, an auction system and auction processing method increasing the percentage of the articles for which transactions are established even if the pricing is not suitable can be provided.

Also, an auction processing apparatus and auction processing method for hosting network auctions so as to facilitate re-auction in the case of failure of establishment of a transaction can be provided.

Also, an auction processing apparatus and auction processing method for participating in a network auction so as to facilitate re-auction in the case of failure of establishment of a transaction can be provided.

Also, an auction system and auction processing method enabling various procedures from the determination of the successful bid to the completion of the transaction to be performed automatically and thereby reducing the complicated trouble and work of participants in the auction, shortening the period from determination of the successful bid to the completion of the transaction, and thereby enabling transactions based on auctions to be efficiently carried out can be provided.

Also, an auction processing apparatus serving as a server and method of the same providing an auction system enabling transactions based on auctions to be efficiently carried out in this way can be provided.

Further, an information processing system and method relating to a trial system enabling quick and inexpensive resolution of trouble in e-commerce can be provided.

INDUSTRIAL APPLICABILITY

The auction system, auction processing apparatus, auction processing method, information processing system, and information processing method of the present invention can be applied to A network auction system and e-commerce transaction system.

The invention claimed is:

1. A computer-implemented auction system for carrying out an auction in a computer network to which a plurality of devices are connected, comprising:

a submitting node device configured to transmit to an auction management device:

product information describing a product, re-auction information indicating whether the product is to be re-auctioned or not to be re-auctioned when an initial auction fails to result in a transaction, and sale conditions information including sale conditions for the product;

the auction management device, which is configured to:

receive said product information, said re-auction information, and said sale conditions information, present said product for auction, based on said product information, receive at least one bid indicating purchase conditions from at least one bidding node device, determine whether the purchase conditions indicated by any of the at least one bid match the sale conditions for the product, and (a) when (i) the purchase conditions indicated by none of the at least one bid match the sale conditions for the product and (ii) the re-auction information indicates that the product is to be re-auctioned when an initial auction fails to result in a transaction, re-present said product for auction, and (b) when (i) the purchase conditions indicated by none of the at least one bid match the sale conditions for the product and (ii) the re-auction information indicates that the product is not to be re-auctioned when an initial auction fails to result in a transaction, end the auctioning of said product such that said product is no longer for sale; and the at least one bidding node device, which is configured to view the product presented for auction by the auction management device and place the at least one bid indicating purchase conditions with respect to the viewed product.

2. A computer-implemented auction system as set forth in claim 1, wherein said submitting node device is configured to transmit at the same time to the auction management device said product information, said re-auction information, and said sale conditions information.

3. A computer-implemented auction system as set forth in claim 1, wherein said sale conditions for the product include a minimum reserve, said purchase conditions indicated by any of the at least one bid include a bid amount, and said auction management device is configured to determine whether the purchase conditions indicated by any of the at least one bid match the sale conditions for the product by comparing said bid amount to said minimum reserve.

4. A computer-implemented auction system as set forth in claim 1, wherein said product information for said product for auction includes a category associated with said product for auction, and said auction management device is configured to change the category associated with said product for auction when re-presenting said product for auction.

5. A computer-implemented auction system as set forth in claim 1, wherein said sale conditions for the product include information designating an auction period, and said auction management device is configured to change said auction period when re-presenting said product for auction.

* * * * *